US010889987B2

(12) United States Patent
Patterson

(10) Patent No.: US 10,889,987 B2
(45) Date of Patent: Jan. 12, 2021

(54) FELT BAFFLE WITH SNAP ENDS

(71) Applicant: 3form LLC, Salt Lake City, UT (US)

(72) Inventor: Caleb Lawrence Patterson, Seattle, WA (US)

(73) Assignee: 3FORM, LLC, Salt Lake City, UT (US)

( * ) Notice: Subject to any disclaimer, the term of this patent is extended or adjusted under 35 U.S.C. 154(b) by 0 days.

(21) Appl. No.: 15/902,731

(22) Filed: Feb. 22, 2018

(65) Prior Publication Data

US 2018/0334804 A1 Nov. 22, 2018

Related U.S. Application Data

(60) Provisional application No. 62/508,855, filed on May 19, 2017.

(51) Int. Cl.
*E04B 9/36* (2006.01)
*F21V 21/005* (2006.01)
(Continued)

(52) U.S. Cl.
CPC ..... *E04B 9/363* (2013.01); *E04B 1/8404* (2013.01); *E04B 9/001* (2013.01); *E04B 9/26* (2013.01); *E04F 13/0801* (2013.01); *F21S 2/005* (2013.01); *F21S 8/06* (2013.01); *F21V 21/005* (2013.01); *F21V 21/008* (2013.01);
(Continued)

(58) Field of Classification Search
CPC . E04B 9/363; E04B 9/26; E04B 9/001; E04B 1/8404; E04B 9/366; E04B 9/006; G10K 11/16; E04F 13/0801; F21V 21/008; F21V 21/005; F21V 33/00; F21S 8/06; F21S 2/005
See application file for complete search history.

(56) References Cited

U.S. PATENT DOCUMENTS

D97,213 S 11/1869 Stone
D101,033 S 3/1870 Glatthar et al.
(Continued)

FOREIGN PATENT DOCUMENTS

DE 2349401 4/1975
DE 102008026504 3/2009
(Continued)

OTHER PUBLICATIONS

Search Report for application No. GB1715859.3 dated Oct. 2, 2018.
(Continued)

*Primary Examiner* — Jessie T Fonseca
(74) *Attorney, Agent, or Firm* — Workman Nydegger

(57) ABSTRACT

Embodiments described herein are directed to a sound-dampening baffle and lighting apparatus and methods of production therefor. In one embodiment, a sound-dampening baffle and lighting apparatus is provided that includes a structural frame which provides support for a sound-dampening outer layer and a light source. The sound-dampening outer layer is disposed around the structural frame. The sound-dampening baffle and lighting apparatus also includes a light source disposed on the structural frame. The light source is directionally switchable so that light emanating from the light source points upward, downward or both.

55 Claims, 14 Drawing Sheets

(51) Int. Cl.

| | |
|---|---|
| ***E04B 1/84*** | (2006.01) |
| ***G10K 11/16*** | (2006.01) |
| ***E04B 9/00*** | (2006.01) |
| ***F21S 8/06*** | (2006.01) |
| ***F21V 33/00*** | (2006.01) |
| ***F21S 2/00*** | (2016.01) |
| ***F21V 21/008*** | (2006.01) |
| ***E04B 9/26*** | (2006.01) |
| ***E04F 13/08*** | (2006.01) |

(52) U.S. Cl.
CPC ..... *F21V 33/00* (2013.01); *G10K 11/16* (2013.01); *E04B 9/006* (2013.01); *E04B 9/366* (2013.01)

(56) References Cited

U.S. PATENT DOCUMENTS

D101,034 S 3/1870 Glatthar et al.
D136,518 S 3/1873 Hofstetter
D676,587 S 6/1901 Fisher
D676,996 S 6/1901 Gismondi
D684,294 S 10/1901 Goodson
D686,363 S 11/1901 Smith
D697,662 S 4/1902 Patterson
D708,391 S 9/1902 Coury
D745,206 S 11/1903 Clark
D764,095 S 7/1904 Clark
1,335,513 A 3/1920 Link
1,335,613 A 3/1920 Cuno
1,963,218 A 6/1934 Wakefield
D123,049 S 10/1940 Doane
2,525,556 A 10/1950 Marchisio
D166,671 S 5/1952 Jernigan
2,715,449 A 8/1955 Lemmerman et al.
2,759,093 A * 8/1956 Ferar et al. ..... F21V 7/0016 362/234
3,367,581 A 2/1968 Kizilos et al.
3,385,963 A 5/1968 Washick
D232,257 S 7/1974 Paulson
D239,780 S 5/1976 Paulson
3,967,823 A 7/1976 Yount
D264,136 S 4/1982 Castiglioni
4,437,287 A * 3/1984 Halfaker ..... E04B 9/0435 52/145
4,555,114 A 11/1985 Dozier
4,716,671 A 1/1988 Gross
4,726,781 A 2/1988 Bernhart
4,738,066 A 4/1988 Reed
4,799,526 A 1/1989 Reeves
5,226,724 A 7/1993 Kanarek
D338,620 S 8/1993 Brozowski
5,282,600 A 2/1994 Weiss
D361,398 S 8/1995 Neall, III
5,532,073 A 7/1996 Hirata
5,532,912 A 7/1996 Bendit
5,658,066 A 8/1997 Hirsch
5,662,412 A 9/1997 Glendmyer
D387,459 S 12/1997 Cool
5,702,180 A 12/1997 Huang
D391,881 S 3/1998 Youseph
D392,119 S 3/1998 Montoya
5,758,588 A 6/1998 Orfali
5,947,786 A 9/1999 Glick
D416,103 S 11/1999 Hashmi
5,989,015 A 11/1999 Guerin
6,025,549 A 2/2000 Harris
D431,187 S 9/2000 Davis
D432,868 S 10/2000 Tan
D438,858 S 3/2001 del Castillo
6,302,566 B1 10/2001 Cohon
6,341,880 B1 1/2002 Hsu
6,367,581 B1 4/2002 Marler et al.
D468,474 S 1/2003 Poulton
6,530,674 B2 3/2003 Grierson
D508,580 S 8/2005 Norris et al.
6,964,507 B2 11/2005 Mohacsi
6,984,055 B2 1/2006 McCarthy
D523,328 S 6/2006 Ramos
D523,771 S 6/2006 Kwan
D525,384 S 7/2006 Waycaster
D525,738 S 7/2006 Waycaster
D536,468 S 2/2007 Crosby
D541,970 S 5/2007 Blackman
D544,006 S 6/2007 Pinchot
D559,994 S 1/2008 Nagakubo
D566,320 S 4/2008 Kim
D566,882 S 4/2008 Min
D570,026 S 5/2008 Waldmann
7,380,957 B2 6/2008 Lanczy
7,431,489 B2 10/2008 Yeo et al.
D584,848 S 1/2009 Menke
7,504,159 B1 3/2009 Suare
D591,444 S 4/2009 Beno et al.
D592,793 S 5/2009 Chandler
D595,887 S 7/2009 Blom
D595,888 S 7/2009 Sabemig
D595,891 S 7/2009 Sabernig
D596,452 S 7/2009 Komorski
D599,037 S 8/2009 Henriquez
D600,394 S 9/2009 Ambruster
D603,083 S 10/2009 Trumble
D605,333 S 12/2009 Miranda
D613,897 S 4/2010 Thun
D621,989 S 8/2010 Proner
7,766,536 B2 8/2010 Peifer
7,789,544 B1 9/2010 Roach et al.
D626,278 S 10/2010 Sabernig
D628,218 S 11/2010 Tommassini
D629,554 S 12/2010 Gielen
D630,365 S 1/2011 Sabernig
D632,004 S 2/2011 Waldmann
D641,520 S 7/2011 Grajcar
7,971,680 B2 7/2011 Morgan, III et al.
D650,509 S 12/2011 Wegger
D653,794 S 2/2012 Friedman
D654,703 S 2/2012 Lemay
D657,487 S 4/2012 Sabernig
D664,282 S 7/2012 Santoro et al.
D665,525 S 8/2012 Patterson
D666,354 S 8/2012 Bracher
D666,757 S 9/2012 Fisher et al.
D667,986 S 9/2012 Decq
D668,371 S 10/2012 Alpasian
D669,759 S 10/2012 Catilleja
8,287,146 B2 10/2012 Hysky
D671,676 S 11/2012 Komarov
D684,307 S 6/2013 Teller
D687,589 S 8/2013 Wick
8,517,845 B2 8/2013 Shin
D689,647 S 9/2013 Brott et al.
D692,391 S 10/2013 Kim
D693,045 S 11/2013 Kirshhoffer et al.
D698,983 S 2/2014 Rampolla
D700,732 S 3/2014 Clark et al.
D702,390 S 4/2014 Clark
D702,391 S 4/2014 Clark
8,714,775 B2 5/2014 Bracher
D709,235 S 7/2014 Chu
RE45,162 E 9/2014 Hierzer
D716,486 S 10/2014 Martin
8,953,926 B1 2/2015 Kelly
8,967,823 B2 3/2015 D'Antonio
D727,550 S 4/2015 Clark et al.
D727,551 S 4/2015 Clark et al.
D727,554 S 4/2015 Clark et al.
D728,145 S 4/2015 Shiqiang
9,004,713 B2 4/2015 Mandy et al.
D729,437 S 5/2015 Hillstrom
9,028,114 B2 5/2015 Smith
9,147,390 B2 8/2015 Swinkels et al.
D740,479 S 10/2015 Beno et al.
D744,132 S 11/2015 Hollingworth
9,194,124 B2 11/2015 Johnson et al.

(56) References Cited

U.S. PATENT DOCUMENTS

| | | | |
|---|---|---|---|
| D747,539 | S | 1/2016 | Santoro et al. |
| D751,237 | S | 3/2016 | Ferrier et al. |
| 9,279,558 | B2 | 3/2016 | Gnasienco |
| D760,420 | S | 6/2016 | Tomlinson |
| D761,478 | S | 7/2016 | Ng |
| D761,990 | S | 7/2016 | Ng |
| D761,991 | S | 7/2016 | Clark |
| D761,992 | S | 7/2016 | Ng |
| 9,404,646 | B2 | 8/2016 | Clark et al. |
| 9,406,594 | B2 | 8/2016 | Blakely et al. |
| D766,536 | S | 9/2016 | Karatas |
| 9,441,807 | B2 | 9/2016 | Smith |
| D768,905 | S | 10/2016 | Sonneman |
| D768,906 | S | 10/2016 | Sonneman |
| 9,459,399 | B2 | 10/2016 | Krijn et al. |
| D773,098 | S | 11/2016 | Czech |
| D773,099 | S | 11/2016 | Sonneman |
| D774,239 | S | 12/2016 | Pardo |
| D774,679 | S | 12/2016 | Huyghe |
| D774,682 | S | 12/2016 | Chen |
| D776,855 | S | 1/2017 | Rashid |
| D780,364 | S | 2/2017 | Czech et al. |
| D780,976 | S | 3/2017 | Czech et al. |
| D783,197 | S | 4/2017 | Amdt |
| 9,618,171 | B2 | 4/2017 | Sepkhanov et al. |
| D786,481 | S | 5/2017 | Wiedemer |
| D786,483 | S | 5/2017 | Sonneman |
| 9,644,820 | B2 | 5/2017 | Clark |
| D790,103 | S | 6/2017 | Czech et al. |
| 9,683,721 | B2 | 6/2017 | Clark et al. |
| D791,385 | S | 7/2017 | Sonneman |
| D791,401 | S | 7/2017 | Sonneman |
| D792,006 | S | 7/2017 | Sonneman |
| D792,632 | S | 7/2017 | Amato |
| D792,633 | S | 7/2017 | Sonneman |
| D794,241 | S | 8/2017 | Huyghe |
| D797,977 | S | 9/2017 | Farzan |
| D797,982 | S | 9/2017 | Sonneman |
| D799,097 | S | 10/2017 | Sonneman |
| D800,368 | S | 10/2017 | Czech et al. |
| 9,792,891 | B2 | 10/2017 | Swinkels et al. |
| D802,819 | S | 11/2017 | Czech et al. |
| 9,822,938 | B2 | 11/2017 | De Gier |
| 9,851,094 | B2 | 12/2017 | Gommans et al. |
| D806,927 | S | 1/2018 | Rashid |
| D806,929 | S | 1/2018 | Clark |
| D810,993 | S | 2/2018 | Genovese |
| 9,920,525 | B1 | 3/2018 | Underkofler et al. |
| D817,537 | S | 5/2018 | Clark |
| 9,964,692 | B2 | 5/2018 | SanFacon et al. |
| D819,860 | S | 6/2018 | Clark |
| 9,995,466 | B2 | 6/2018 | SanFacon et al. |
| 10,024,522 | B2 | 7/2018 | Clark et al. |
| 10,030,850 | B2 | 7/2018 | Vissenberg et al. |
| D825,811 | S | 8/2018 | Clark |
| D826,450 | S | 8/2018 | Clark |
| D827,908 | S | 9/2018 | Silver et al. |
| D828,612 | S | 9/2018 | Silver et al. |
| D835,333 | S | 12/2018 | Silver |
| D836,238 | S | 12/2018 | Ericson, Jr. et al. |
| 10,151,454 | B2 | 12/2018 | Farrell et al. |
| 10,274,664 | B2 | 4/2019 | Wang et al. |
| D848,047 | S | 5/2019 | Santoro et al. |
| 10,359,163 | B1 | 7/2019 | Hettwer et al. |
| D858,853 | S | 9/2019 | Anastassiades |
| D860,507 | S | 9/2019 | Greenberg et al. |
| D861,960 | S | 10/2019 | Ng et al. |
| D880,043 | S | 3/2020 | Guerra et al. |
| 10,672,376 | B1 | 6/2020 | Pickens et al. |
| D889,732 | S | 7/2020 | Silver |
| 2001/0046621 | A1 | 11/2001 | Colli |
| 2002/0071281 | A1 | 6/2002 | Dickson |
| 2004/0027830 | A1 | 2/2004 | Chen |
| 2006/0146531 | A1 | 6/2006 | Reo et al. |
| 2007/0058377 | A1 | 3/2007 | Zampini, II et al. |
| 2007/0247842 | A1 | 10/2007 | Zampini et al. |
| 2008/0266842 | A1 | 10/2008 | Skidmore et al. |
| 2008/0314944 | A1 | 12/2008 | Tsai |
| 2009/0126139 | A1 | 5/2009 | Batti et al. |
| 2010/0149791 | A1 | 7/2010 | McCane et al. |
| 2011/0170294 | A1 | 7/2011 | Mier-Langner |
| 2012/0081919 | A1 | 4/2012 | Parker |
| 2013/0016847 | A1 | 1/2013 | Steiner |
| 2013/0094225 | A1 | 4/2013 | Leichner |
| 2013/0148357 | A1 | 6/2013 | Johnson et al. |
| 2014/0009927 | A1 | 1/2014 | Gnasienco |
| 2014/0022759 | A1 | 1/2014 | Li |
| 2014/0024249 | A1 | 1/2014 | Adams et al. |
| 2014/0063803 | A1 | 3/2014 | Yaphe |
| 2014/0133150 | A1 | 5/2014 | Pardikes et al. |
| 2014/0153257 | A1 | 6/2014 | Smith |
| 2014/0198494 | A1 | 7/2014 | Lextar |
| 2014/0334178 | A1 | 11/2014 | Zharov |
| 2015/0226384 | A1 | 8/2015 | Park |
| 2015/0300605 | A1 | 10/2015 | Clark |
| 2015/0300610 | A1 | 10/2015 | DeCarr et al. |
| 2016/0061429 | A1 | 3/2016 | Waalkes |
| 2016/0245488 | A1 | 8/2016 | Clark |
| 2016/0281940 | A1 | 9/2016 | Kim |
| 2017/0138561 | A1 | 5/2017 | Van Strander |
| 2017/0159928 | A1 | 6/2017 | Gommans et al. |
| 2017/0268752 | A1 | 9/2017 | Horvath et al. |
| 2017/0370098 | A1 | 12/2017 | Honji et al. |
| 2018/0127975 | A1 | 5/2018 | Gillette et al. |
| 2018/0180233 | A1 | 6/2018 | Mellor |
| 2018/0226003 | A1 | 8/2018 | Szekely |
| 2018/0245334 | A1 | 8/2018 | Udagawa et al. |
| 2018/0266668 | A1 | 9/2018 | Myers et al. |
| 2018/0267228 | A1 | 9/2018 | Epstein et al. |
| 2018/0334804 | A1 | 11/2018 | Patterson |
| 2018/0336875 | A1 | 11/2018 | Patterson et al. |
| 2019/0017260 | A1 | 1/2019 | Bou Harb et al. |
| 2019/0035376 | A1* | 1/2019 | Pilaar ..... G10K 11/168 |
| 2019/0041570 | A1 | 2/2019 | Yeo et al. |
| 2019/0088241 | A1 | 3/2019 | Czech et al. |
| 2019/0096954 | A1 | 3/2019 | Crompvoets et al. |
| 2019/0106883 | A1 | 4/2019 | Moore et al. |
| 2019/0162369 | A1 | 5/2019 | Sonneman et al. |
| 2019/0234595 | A1 | 8/2019 | Beland et al. |
| 2019/0309937 | A1 | 10/2019 | Chen et al. |
| 2020/0053967 | A1 | 2/2020 | Murphy |

FOREIGN PATENT DOCUMENTS

| | | |
|---|---|---|
| DE | 202009013052 | 3/2011 |
| DE | 102012110575 | 5/2014 |
| EP | 2375151 | 10/2011 |
| EP | 2813630 | 5/2013 |
| EP | 2864559 | 4/2015 |
| EP | 2990559 | 3/2016 |
| GB | 2556679 | 6/2018 |
| JP | 2003217332 | 7/2003 |
| JP | 2011159472 | 8/2011 |
| KR | 2020100007653 | 7/2010 |
| KR | 2020120007760 | 11/2012 |
| KR | 101454180 | 10/2014 |
| WO | 2013006790 | 1/2013 |
| WO | 2013058961 | 4/2013 |
| WO | 2013/190447 A2 | 12/2013 |
| WO | 2014/073907 A1 | 5/2014 |
| WO | 2014081621 | 5/2014 |
| WO | 2014/184156 A1 | 11/2014 |
| WO | 2015073907 | 5/2015 |
| WO | 2015184156 | 12/2015 |

OTHER PUBLICATIONS

Office Action in U.S. Appl. No. 29/560,673 dated May 10, 2017.

Light art (available online Oct. 21st 2013) Retrieved from the Internet Mar. 16, 2017, retrieved from the Internet URL: www.youtuve.com (search "Lightart.com".

(56) References Cited

OTHER PUBLICATIONS

Tin eye reference (available online Oct. 8th 2014) Retrieved from the internet Mar. 23, 2017, retrieved from the internet URL: https://tineye.com/search/cb9bd08581564e1b2247fa8b78f73b92f57cc422/ Reference internet site URL:https://www.architonic.com/en/product/henge-light-ring-medium/1149533.
Ring shade 32 LED Pendant (available online Mar. 28th 2015) Retrieved from the internet Mar. 23, 2017, retrieved from the internet URL: https://web-beta.archive.org/web/20150328234600/http://www.sonnemanawayoflight.com/ringshade32ledpendant-p-922.html.
Light in The Box (available online Dec. 30th 2014) Retrieved from the internet Mar. 16, 2017, retrieved from the internet URL: https://www.amazon.com/LightInTheBox-RingHome-Chandeliers-Lighting-110-120V/dp/B00RL1N79W/ref=pd_bxgy_60_img_3?_encoding=UTF8&pd_rd_i=B00RL1N79W&pd_rd_r=0K15VB464BCF6J7RV59C&pd_rd_w=3rhz3&pd_rd_wg=r7lJv&psc=1&refRID=0K15VB4.
International Search Report & Written Opinion for application No. PCT/US14/65816 dated Feb. 19, 2015.
International Search Report & Written Opinion for application No. PCT/US2015/033014 dated Sep. 8, 2015.
International Search Report & Written Opinion for application No. PCT/US2013/070236 dated Mar. 11, 2014.
Office Action in U.S. Appl. No. 14/767,890 dated May 12, 2017.
Office Action in U.S. Appl. No. 14/646,232 dated Dec. 15, 2016.
Ex Parte Quayle Action for U.S. Appl. No. 29/481,765 mailed on May 9, 2016.
Ex Parte Quayle Action for U.S. Appl. No. 29/545,539 mailed on May 23, 2016.
Office Action for U.S. Appl. No. 29/481,765 dated Oct. 16, 2015.
Requirement for Restriction for U.S. Appl. No. 29/530,073 dated May 30, 2017.
Office Action for U.S. Appl. No. 14/646,232 dated May 2, 2016.
Office Action for U.S. Appl. No. 29/560,681 dated Jun. 15, 2017.
Modern Square LED Chandelier Lighting (available online Sep. 22, 2015) Retrieved from the internet Jun. 2, 2017, retrieved from the internet URL: https://www.amazon.com/VONN-VMC31620AL-Chandelier-Lighting-Adjustable/dp/B015OG45GE/ref=sr_1_2?ie=UTF8qid=1498172914&sr=8-2&keywords=Modern+Square+LED+Chandelier+Lighting.
Modern Two-Tier LED Chandelier (available online Sep. 22, 2015) Retrieved from the internet Jun. 2, 2017, retrieved from the internet URL: https://www.amazon.com/VONN-VMC31710SW-Two-Tier-Chandelier-Adjustable/dp/B0150G4J8S/ref=pd_sbs_60_2?_encoding=UTF8&pd_rd_i=B0150G4J8S&pd_rd_r=9GZ57EM9VFSJZMQW1ERC&pd_rd_w=XsCRS&pd_rd_wg=VbWDy&psc=1&refRID=9GZ57EM9VFSJZ.
Astro D-Light wall Light (available online) Retrieved from the internet Jun. 2, 2017, retrieved from the internet URL: https://www.lovelights.co.uk/led-lighting-c17/astro-d-light-led-wall-light-p22295.
Notice of Allowance for U.S. Appl. No. 15/076,852 dated Oct. 11, 2017.
Non-Final Office Action for U.S. Appl. No. 29/530,073 dated Sep. 1, 2017.
Notice of Allowance for U.S. Appl. No. 29/560,673 dated Nov. 13, 2017.
Non-Final Office Action for U.S. Appl. No. 14/912,396 dated Dec. 29, 2017.
Final Office Action for U.S. Appl. No. 14/767,890 dated Dec. 29, 2017.
Non-Final Office Action for U.S. Appl. No. 29/560,686 dated Jan. 9, 2018.
The807, (Feb. 5, 2014), [online], [site visited Jan. 4, 2018]. Available from internet <URL: Retrieved from https://www.etsy.com/uk/listing/176582577/triangle-shadow-box-set-of-3?ref=related-2>.
Non-Final Office Action for U.S. Appl. No. 29/560,688 dated Jan. 9, 2018.
EONeyeofnature. (Jan. 5, 2015), [online], [site visited Jan. 4, 2018]. Available from internet, <URL: Retireved from https://www.etsy.com/uk/listing/217343723/set-of-four-hexagon-honeycomb-shelves-in?show_sold_out_detail=1>.
Search Report for U.S. Appl. No. GB1715859.3 dated Mar. 8, 2018.
Non- Final Office Action for U.S. Appl. No. 14/767,890 dated Jun. 4, 2018.
Acoshape+ Modell Barcode Acoustic Submitted to U.S. Appl. No. 15/973,054 on Aug. 7, 2018.
Acoshape+ Modell Barcode Down Submitted to U.S. Appl. No. 15/973,054 on Aug. 7, 2018.
Acoshape+ Modell Barcode Down/Up Submitted to U.S. Appl. No. 15/973,054 on Aug. 7, 2018.
Acoshape+ Modell Morse 3 Submitted to U.S. Appl. No. 15/973,054 on Aug. 7, 2018.
Acoshape+ Modell Morse 4 Submitted to U.S. Appl. No. 15/973,054 on Aug. 7, 2018.
Modell Slab 150 Submitted to U.S. Appl. No. 15/973,054 on Aug. 7, 2018.
Ringo Star Acoustic-P6/G6 Submitted to U.S. Appl. No. 15/973,054 on Aug. 7, 2018 Dated Jun. 6, 2017.
Spectral Blade Light and Acoustic Baffles Submitted to U.S. Appl. No. 15/973,054 on Aug. 7, 2018 Dated Jun. 2017.
"Mounted Lighting LED Linear Trunking Light (available online) Retrieved from the internet Sep. 27, 2018 from URL: https://hkenrich.en.made-in-china.com/productimage/JNrxl IEKu Yha-2f1j00gaYGPSmBbqoC/China-3-U Years-Warranty-Ceiling-Mounted-Lighting-LED-Linear-Trunking-L".
"Mumu LED Linear Suspension Pendant Light (available online) Retrieved from the internet Sep. 27, 2018 from URL: https://www.ylighting.com/mumu-led-linear-suspension-pendant-light-by-seed-design-SEDP149479.html#cgid=%DAYLLIG9%0A&&V tileIndex=14".
Non- Final Office Action for U.S. Appl. No. 29/647,681 dated Jun. 4, 2018.
Search Report for U.S. Appl. No. GB1804368.7 dated Sep. 17, 2018.
Non-Final Office Action for U.S. Appl. No. 29/647,681 dated Nov. 4, 2019.
Office Action dated Aug. 23, 2019 from U.S. Appl. No. 15/719,070, filed Sep. 28, 2017.
Final Office Action for U.S. Appl. No. 15/719,070 dated Feb. 3, 2020.
Search Report for application No. 18162643.3-1015, dated Jul. 13, 2018.
Non-Final Office Action for U.S. Appl. No. 16/577,636 dated Feb. 21, 2020.
Restriction Requirement for U.S. Appl. No. 16/577,636 dated Nov. 5, 2019.
Final Office Action for U.S. Appl. No. 29/647,681 dated Apr. 2. 2019.
Notice of Allowance from U.S. Appl. No. 14/646,232 dated Mar. 24, 2017.
Issue Notification from U.S. Appl. No. 14/646,232 dated Mar. 24, 2017.
IPRP from PCT Application No. PCT/US2013/070236 dated May 26, 2015.
IPRP from PCT Application No. PCT/US2014/065816 dated May 17, 2016.
Notice of Allowance for U.S. Appl. No. 14/912,396 dated May 2, 2018.
Supplemental Notice of Allowability for U.S. Appl. No. 14/912,396 dated Jul. 9, 2018.
Issue Notification for U.S. Appl. No. 14/912,396 dated Aug. 23, 2018.
Final Office Action from U.S. Appl. No. 14/767,890 dated May 17, 2019.
Notice of Allowance from U.S. Appl. No. 29/545,539 dated Jul. 1, 2016.
Issue Notification from U.S. Appl. No. 29/545,539 dated Jul. 27, 2016.
Restriction Requirement from U.S. Appl. No. 29/481,765 dated Jun. 18, 2015.

(56) References Cited

OTHER PUBLICATIONS

Notice of Allowance from U.S. Appl. No. 29/481,765 dated Jun. 7, 2016.
Issue Notification from U.S. Appl. No. 15/076,852 dated Dec. 20, 2017.
Notice of Allowance from U.S. Appl. No. 15/076,852 dated Jan. 16, 2018.
Issue Notification from U.S. Appl. No. 15/076,852 dated Jan. 31, 2018.
Notice of Allowance from U.S. Appl. No. 29/560,281 dated Mar. 26, 2018.
Issue Notification from U.S. Appl. No. 29/560,281 dated May 16, 2018.
Notice of Allowance from U.S. Appl. No. 29/560,686 dated May 22, 2018.
Corrected Notice of Allowability from U.S. Appl. No. 29/560,686 dated Jul. 11, 2018.
Issue Notification from U.S. Appl. No. 29/560,686 dated Aug. 1, 2018.
Issue Notification from U.S. Appl. No. 29/560,673 dated Dec. 13, 2017.
Issue Notification from U.S. Appl. No. 29/530,073 dated Mar. 14, 2018.
Restriction Requirement from U.S. Appl. No. 15/719,070 dated May 6, 2019.
Notice of Allowance from U.S. Appl. No. 29/560,688 dated May 22, 2018.
Issue Notification from U.S. Appl. No. 29/560,688 dated Jul. 25, 2018.
Highly Effective Acoustic Baffles (available online) Retrieved from the internet Aug. 3, 2020 from URL: www.soundsorba.com/acoustic-products/sound-absorption/bafflesorba/.
Non-Final Office Action dated Jul. 29, 2019 for U.S. Appl. No. 15/902,731, filed Feb. 22, 2018.
Notice of Allowance for U.S. Appl. No. 15/902,731 dated Feb. 26, 2020.
Notice of Allowance received for U.S. Appl. No. 16/577,636, dated Jul. 21, 2020, 5 pages.
Office Action in U.S. Appl. No. 15/076,852 dated Jun. 2, 2017.
Architonic_light_ring_Tin_Eye_search_result_Oct_28th_2014 (available online Oct. 28, 2014) Retieved from the internet Aug. 11, 2020 from URL: https://tineye.com/search/8ef4cda898fab73fd1d06a6d7262af01589cc18b?sort=score&order=desc&page=1.
Matric Ready Square 2in Suspension G3/R4 (available online) Retrieved from the internet Aug. 17, 2020 from URL: https://www.lightformshop.com/Brands-lights/matric-ready-square-2in-suspension-g3-r4.
Morfi Small (available online) Retieved from the internet Aug. 14, 2020 from URL: https://www.architonic.com/en/product/petridis-s-a-morfi-small/20103072.
Notice of Allowance received for U.S. Appl. No. 16/577,636, dated Aug. 21, 2020, 5 pages.
Shop.ferguson Foyer Pendant tineye reference (available online Mar. 2, 2015) Retrieved from the internet Aug. 17, 2020 from URL: https://tineye.com/search/9ae3a7322908e09d1d83fcc3df9d473b18a90f1c?sort=crawl_date&order=asc&page=1 1.
Triangle Pendantjampjavailalbe online Dec. 29, 2017) Retrieved from the internet Aug. 16, 2020 from URL: https:// www.archiproducts.com/en/products/hollis-morris/led-indirect-light-pendant-lamp-triangle-pendant-lamp_265978.
Notice of Allowance received for U.S. Appl. No. 16/577,636, dated Oct. 9, 2020, 2 pages.

* cited by examiner

FELT BAFFLE WITH SNAP ENDS

CROSS-REFERENCE TO RELATED APPLICATIONS

This application claims priority to and the benefit of U.S. Provisional Patent Application No. 62/508,855, filed on May 19, 2017, entitled "Felt Baffle with Snap Ends," which application is incorporated by reference in its entirety herein.

BACKGROUND

Baffles may be used to deflect or channel sound within a room. For instance, a sound-absorbing baffle may be installed on the walls of a home theater room to channel or diffuse the sound produced by speakers in the room. Additionally or alternatively, baffles may be used to channel light within a room. For example, baffles may be included as part of a light fixture. The light fixture may be simple or ornate, and may include little more than a housing for a light bulb, or may have intricate, multi-faceted designs. Baffles may be used in both commercial and residential settings to provide a desired look and feel to a room, or to provide certain acoustic properties to the room. Baffles may be made in many different styles, and may be made from many different types of materials.

Traditionally, sound baffles and light baffles have been engineered and manufactured separately. For instance, acoustics for a given room may be determined by a sound engineer. Baffles may then be designed and installed in order to diffuse sounds in a region that is currently producing echoes. Similarly, lighting for that same room or a different room may be evaluated and designed to provide a specified look and feel, accentuating certain parts with light and leaving others dark. Lighting designers may use baffles to subdue or enhance lighting in any given region of the room. However, by addressing each issue separately, efforts may be duplicated in finding a proper balance for acoustics and lighting within a room.

BRIEF SUMMARY

Embodiments described herein are directed to a sound-dampening baffle and lighting apparatus and methods of production therefor. In one embodiment, a sound-dampening baffle and lighting apparatus is provided that includes a structural frame which provides support for a sound-dampening outer layer and a light source. The sound-dampening outer layer is disposed around the structural frame. The sound-dampening baffle and lighting apparatus also includes a light source disposed on the structural frame. The light source is directionally switchable so that light emanating from the light source points upward, downward or both.

In another embodiment, a method of manufacturing a sound-dampening baffle and lighting apparatus is provided. The method of manufacturing includes providing a structural frame that supports a sound-dampening outer layer and a light source. The method also includes wrapping the sound-dampening outer layer around at least a portion of the structural frame, and affixing the light source to the structural frame. The light source is directionally switchable such that light emanating from the light source points upward, downward or both.

In another embodiment, a light fixture is provided. The light fixture includes an interior frame that provides structural support for one or more external layers. The light fixture also includes a hanging apparatus connected to the interior frame that allows the light fixture to be hung from the ceiling. The light fixture also has an external sound-dampening layer wrapped around at least part of the interior frame. Still further, the light fixture has lights mounted on the interior frame, where the lights are programmable to cast light in a variety of directions. The light fixture also includes a controller electrically connected to the lights. The controller is configured to direct light emanated from the lights in a specified direction.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be apparent to one of ordinary skill in the art from the description, or may be learned by the practice of the teachings herein. Features and advantages of embodiments described herein may be realized and obtained by means of the instruments and combinations particularly pointed out in the appended claims. Features of the embodiments described herein will become more fully apparent from the following description and appended claims.

BRIEF DESCRIPTION OF THE DRAWINGS

To further clarify the above and other features of the embodiments described herein, a more particular description will be rendered by reference to the appended drawings. It is appreciated that these drawings depict only examples of the embodiments described herein and are therefore not to be considered limiting of its scope. The embodiments will be described and explained with additional specificity and detail through the use of the accompanying drawings in which.

DETAILED DESCRIPTION

Figure 1A:
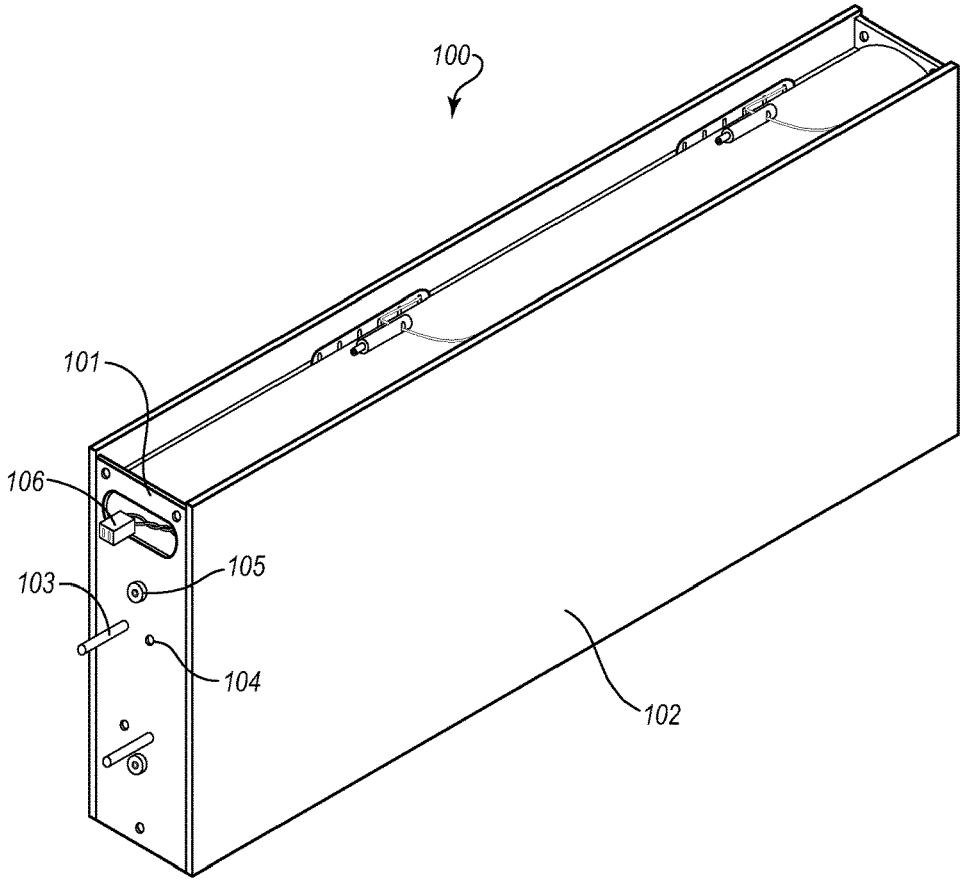
FIGS. 1A-1H illustrate various views of a sound-dampening baffle and lighting apparatus.

As noted above, embodiments described herein are directed to a sound-dampening baffle and lighting apparatus and methods of production therefor. In one embodiment, a sound-dampening baffle and lighting apparatus is provided that includes a structural frame which provides support for a sound-dampening outer layer and a light source. The sound-dampening outer layer is disposed around the structural frame. The sound-dampening baffle and lighting apparatus also includes a light source disposed on the structural frame. The light source is directionally switchable so that light emanating from the light source points upward, downward or both.

In another embodiment, a method of manufacturing a sound-dampening baffle and lighting apparatus is provided. The method of manufacturing includes providing a structural frame that supports a sound-dampening outer layer and a light source. The method also includes wrapping the sound-dampening outer layer around at least a portion of the structural frame, and affixing the light source to the structural frame. The light source is directionally switchable such that light emanating from the light source points upward, downward or both.

In another embodiment, a light fixture is provided. The light fixture includes an interior frame that has ceiling mounts, lighting mounts, and mounts for an external sound-dampening layer. The light fixture also includes an external sound-dampening layer wrapped around at least part of the interior frame. Furthermore, the light fixture includes lights mounted on the lighting mounts of the interior frame, where the lights are programmable to cast light in a variety of directions. Still further, the light fixture includes a controller electrically connected to the lights. The controller is configured to direct light emanated from the lights in specified directions.

Before describing the present disclosure in detail, it is to be understood that this disclosure is not limited to the specific parameters of the particularly exemplified systems, apparatus, assemblies, products, devices, kits, methods, and/or processes, which may, of course, vary. It is also to be understood that much, if not all of the terminology used herein is only for the purpose of describing particular embodiments of the present disclosure, and is not necessarily intended to limit the scope of the disclosure in any particular manner. Thus, while the present disclosure will be described in detail with reference to specific configurations, embodiments, and/or implementations thereof, the descriptions are illustrative only and are not to be construed as limiting the scope of the claimed invention.

Various aspects of the present disclosure, including devices, systems, methods, etc., may be illustrated with reference to one or more exemplary embodiments or implementations. As used herein, the terms "exemplary embodiment" and/or "exemplary implementation" mean "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

Furthermore, unless defined otherwise, all technical and scientific terms used herein have the same meaning as commonly understood by one of ordinary skill in the art to which the present disclosure pertains. While a number of methods, materials, components, etc. similar or equivalent to those described herein can be used in the practice of the present disclosure, only certain exemplary methods, materials, components, etc. are described herein.

It will be noted that, as used in this specification and the appended claims, the singular forms "a," "an" and "the" include plural referents unless the content clearly dictates otherwise. Thus, for example, reference to a "column" includes one, two, or more columns. Similarly, reference to a plurality of referents should be interpreted as comprising a single referent and/or a plurality of referents unless the content and/or context clearly dictate otherwise. Thus, reference to "columns" does not necessarily require a plurality of such columns. Instead, it will be appreciated that independent of conjugation; one or more columns are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct association between two components or, where appropriate, an indirect association with one another through intervening or intermediate components. In contrast, when a component is referred to as being "directly coupled", "directly attached", "directly connected," and/or "directly joined" to another component, no intervening elements are present or contemplated.

Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "forward," "rear," "left," "right," "up," "down," "upper," "lower," "inner," "outer," "internal," "external," "interior," "exterior," "anterior," "posterior," "proximal," "distal," and the like can be used only for convenience and/or solely to indicate relative directions and/or orientations and may not otherwise be intended to limit the scope of the disclosure, including the specification, invention, and/or claims. According, such directional and/or arbitrary terms are not to be construed as necessarily requiring a specific order or position.

To facilitate understanding, like reference numerals have been used, where possible, to designate like elements common to the figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number.

In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where two or more values, or a range of values (e.g., less than, greater than, at least, and/or up to a certain value, and/or between two recited values) is disclosed or recited, any specific value or range of values falling within the disclosed values or range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

Various modifications can be made to the illustrated embodiments without departing from the spirit and scope of the invention as defined by the claims. Thus, while various aspects and embodiments have been disclosed herein, other aspects and embodiments are contemplated. It is also noted that systems, apparatus, assemblies, products, devices, kits, methods, and/or processes, according to certain embodiments of the present disclosure may include, incorporate, or otherwise comprise properties, features, components, members, and/or elements described in other embodiments disclosed and/or described herein. Thus, reference to a specific feature in relation to one embodiment should not be construed as being limited to applications only within said embodiment. The headings used herein are for organizational purposes only and are not meant to be used to limit the scope of the description or the claims.

Turning now to the Figures, FIGS. 1A-1H generally illustrate an embodiment of a sound-dampening baffle and lighting apparatus 100. The sound-dampening baffle and lighting apparatus 100 may be formed in a generally rectangular shape, although substantially any shape or size may be used. The sound-dampening baffle and lighting apparatus 100 (or "light fixture" herein) includes a structural frame 101 that provides rigidity and support for the various components in the light fixture. The structural frame 101 may be may be made of metal, wood, plastic, ceramic or other material that provides sufficient rigidity and support.

Around the structural frame is wrapped a sound-dampening outer layer 102. The sound-dampening outer layer may be constructed out of substantially any type of sound-dampening material including carpeting, Styrofoam, felted polyethylene terephthalate (PET) fibers, or any other material that has sound-absorbing properties. The sound-dampening outer layer 102 may be wrapped around all or only a portion of the structural frame 101. In FIG. 1A, for example, the sound-dampening outer layer 102 is wrapped around the front face (see FIG. 1B), the back face (see FIG. 1C), and/or the bottom face (see FIG. 1E). In some embodiments, the sound-dampening outer layer 102 is wrapped over the top face, and/or the side faces, although in FIGS. 1D, 1F and 1G, the top, left and right sides, respectively, are shown without a sound-dampening outer layer.

The structural frame 101 further includes elements or features that may be used to link light fixtures together, either mechanically, electrically, or both. For instance connector rods 103 may be affixed to the structural frame 101 in certain positions. The structural frame 101 may also include recesses 104 designed to fit the connector rods 103. Thus, one light fixture 100 may have a connector rod 103, where another light fixture has a corresponding recess 104. Thus, in the light fixture 100 of FIG. 1A, the connector rod 103 may connect to a corresponding recess in another light fixture (not shown), and a connector rod from another light fixture may connect to the recess 104 in structural frame 101. This connector rod may snap fit or may friction fit into the recess to prevent movement of the light fixtures once joined.

Still further, the light fixture 100 may be magnetically connected to other light fixtures via magnetic connection 105. One or more such magnetic connections 105 may be placed on the top, bottom or sides of the light fixture. This allows corresponding magnetic connections in other light fixtures to align and (separably) bind the two light fixtures together. The magnets may be sufficiently strong to bind to each other and hold a firm connection, while not so strong that separation of the light fixtures is overly difficult. Electrical connection 106 may further be used to link two light fixtures. The electrical connection 106 is capable of receiving electricity from a power source and transferring that electricity to a controller and/or to one or more lights. The electrical connection 106 may plug directly into an outlet, or may plug into an electrical connection of another light fixture. Thus, the light fixtures herein may be electrically strung together in sequence.

Figure 1B:
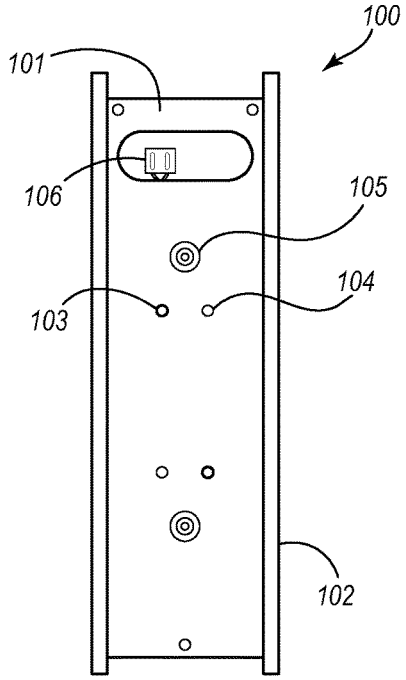
Figure 1C:
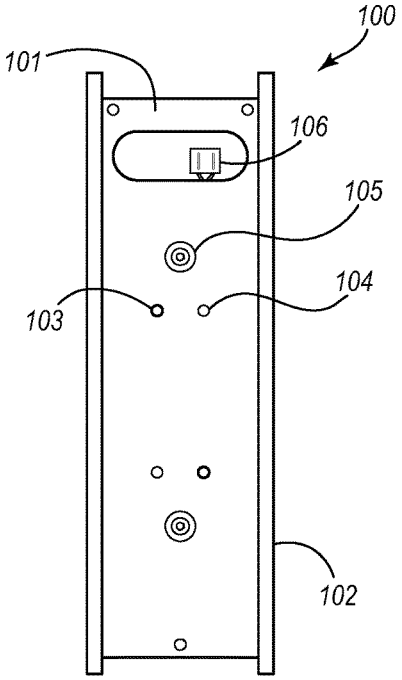
Figure 1D:
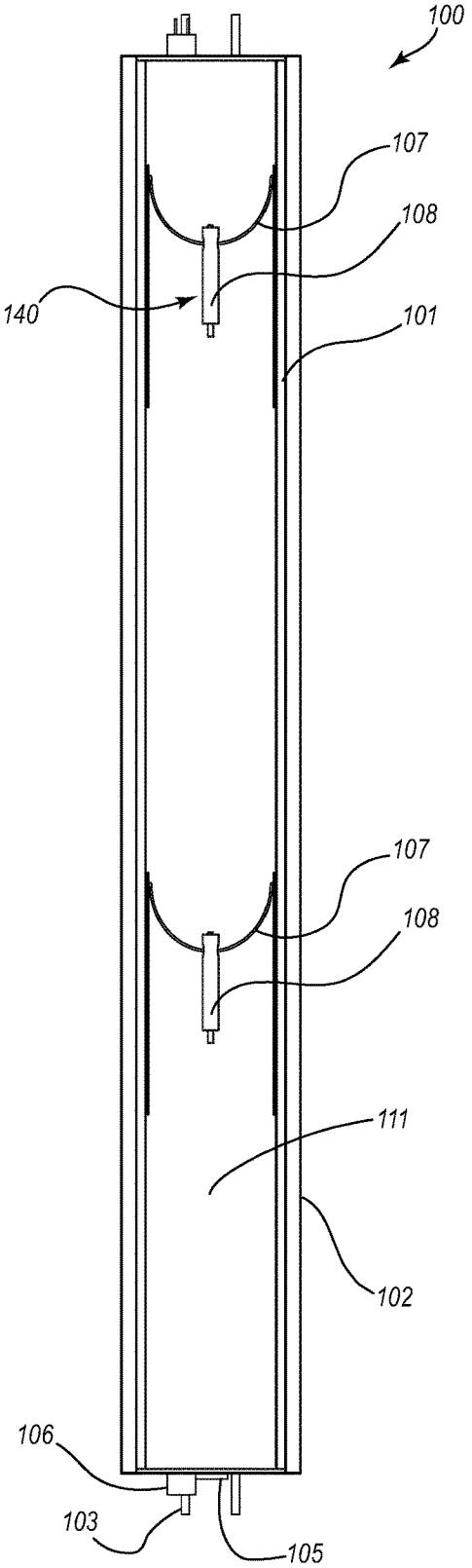

FIG. 1D illustrates a top view of the sound-dampening baffle and lighting apparatus 100. The top portion includes a diffuser 111. The diffuser 111 is designed to diffuse or direct light coming from a light source within the light fixture 100. The diffuser 111 can run the length of the fixture, or can run over parts of the fixture. In some cases, the diffuser 111 may be substantially opaque, so as to block any light coming from within the light fixture 100. In other cases, certain portions of the diffuser may be opaque, while other portions are more transparent. This allows lighting accents to be provided to certain portions of a room, depending where the opaque and more transparent portions of the diffuser are placed. FIG. 1D further illustrates a hanging apparatus 140 that allows the light fixture 100 to be hung from the ceiling. As will be explained further below, the hanging apparatus 140 includes a body portion 108 and hooks 107 that anchor the apparatus to the light fixture's frame (see FIGS. 2A-2C).

Figure 1E:
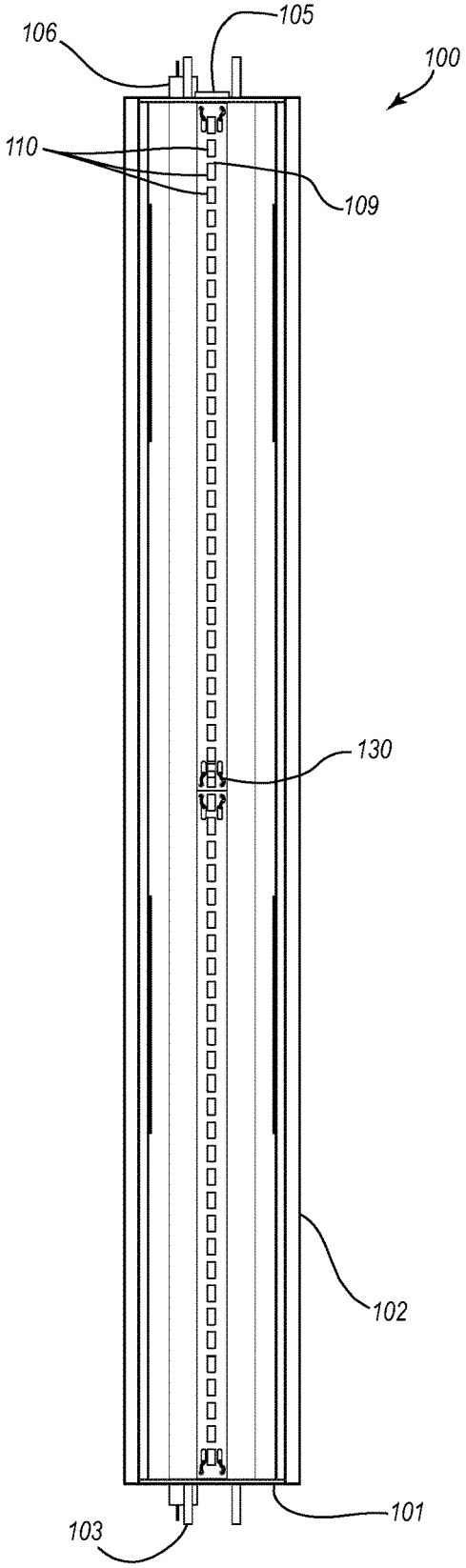

FIG. 1E shows a bottom view of one embodiment of the sound-dampening baffle and lighting apparatus 100. The bottom portion includes a light source such as an LED light strip 109. The LED light strip 109 includes multiple individual LED lights 110 arranged in sequence. Each LED light strip may be connected to other LED light strips using connectors 130. While only two LED light strips are shown connected in sequence, it will be recognized that any number of light strips may be used within a light fixture, and that the light strips may be laid out in many different design patterns.

For example, two or three rows of LED light strips may run the length of the fixture 101 in parallel. In another example, multiple short LED light strips may be placed along the width of the light fixture. Diagonal, circular or other patterns may also be used. Thus, manufacturers or users may have a great deal of flexibility when deciding how the light will be provided from within the light fixture.

Figure 1F:
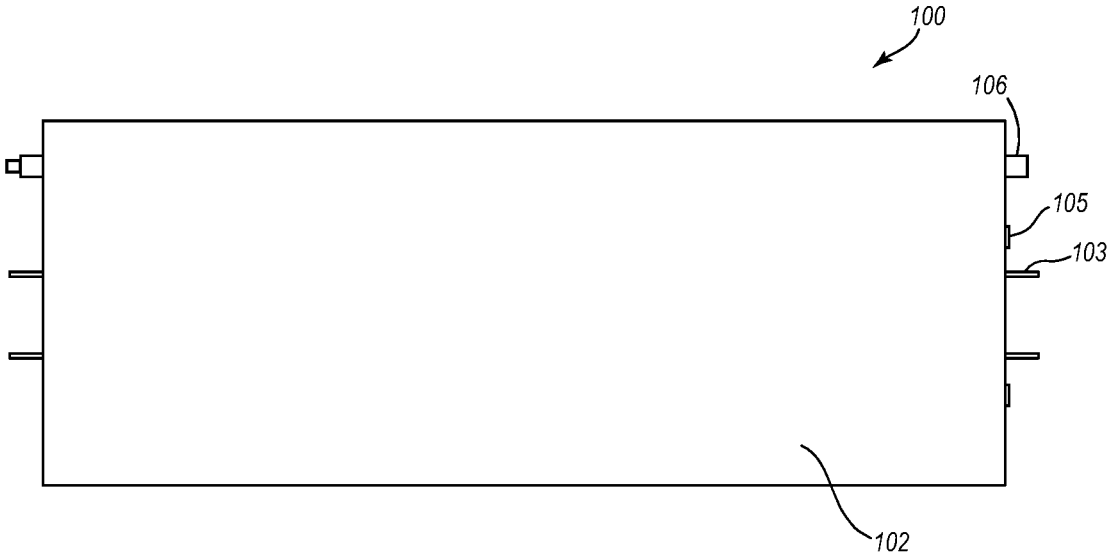
Figure 1G:
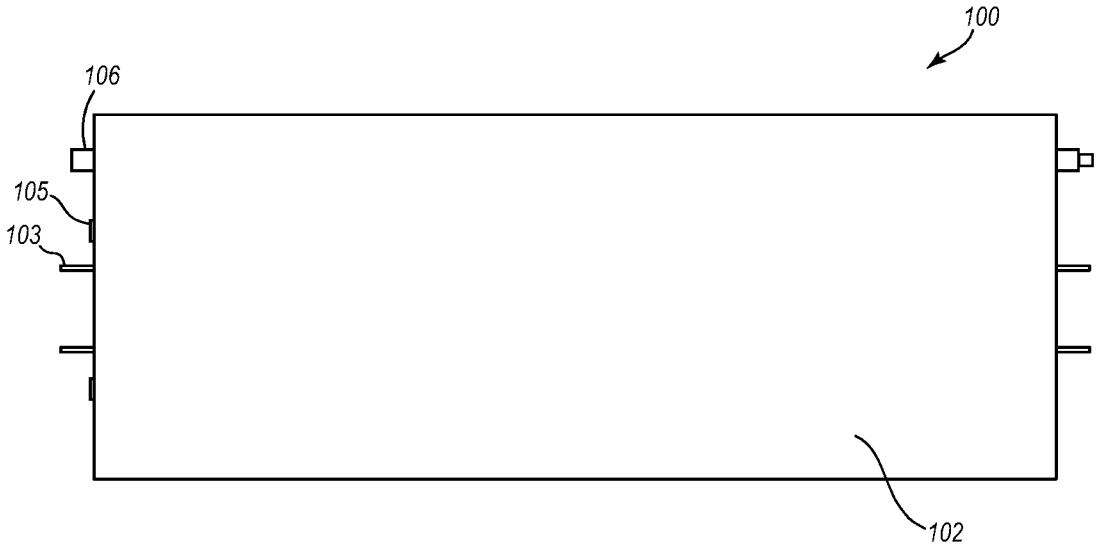
Figure 1H:
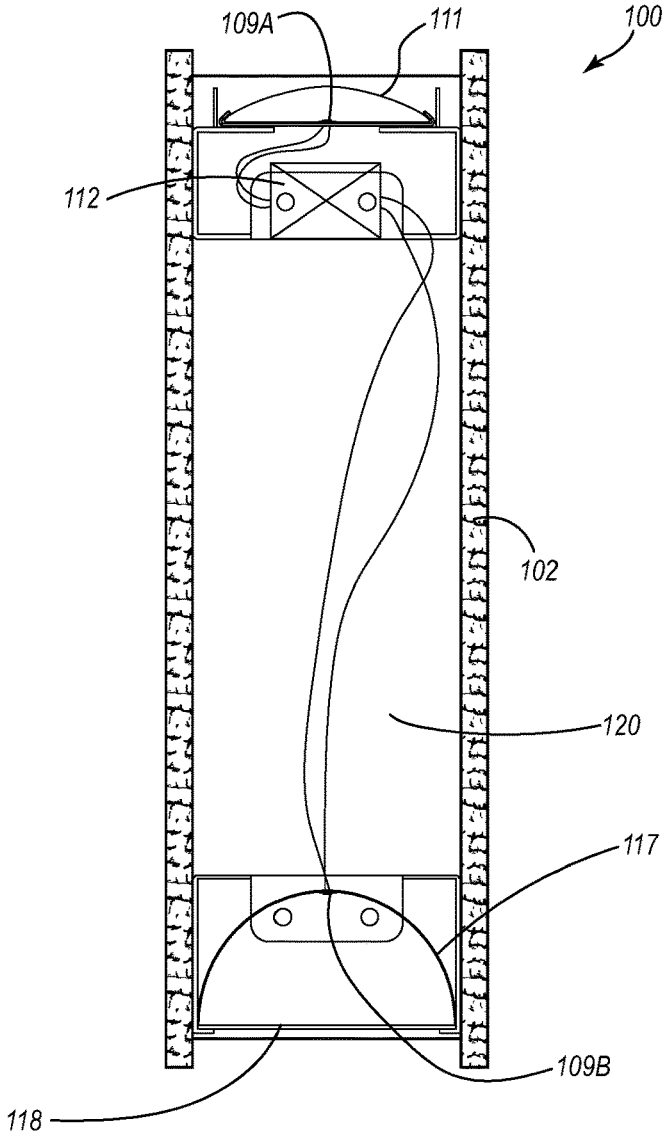

FIGS. 1F and 1G show right and left sides, respectively, while FIG. 1H shows an interior view of the sound-dampening baffle and lighting apparatus 100. In this embodiment, the lighting apparatus 100 includes two light sources: light source 109A at the top and light source 109B at the bottom of the light. Each light source in this embodiment is diffused using a diffuser: 111 on the top and 118 on the bottom. As can be seen from the illustration, a reflector 117 may also be used to direct or focus the light coming from the light source 109. The interior view of FIG. 1H further illustrates an interior space 120 between the two walls of the sound-dampening outer layer 102. The interior space 120 may be empty or filled with other items or materials. For instance, the interior space may include a light controller 112. The light controller 112 may be used to control various aspects of the light fixture 100 including which light sources are turned on, how brightly they are turned on, which individual lights are on, etc. The light controller may include a wireless receiver that receives signals from a remote control or from a wireless network (e.g. Bluetooth or WiFi). In this manner, a user may be able to remotely control all aspects of the light's functionality.

Figure 2A:
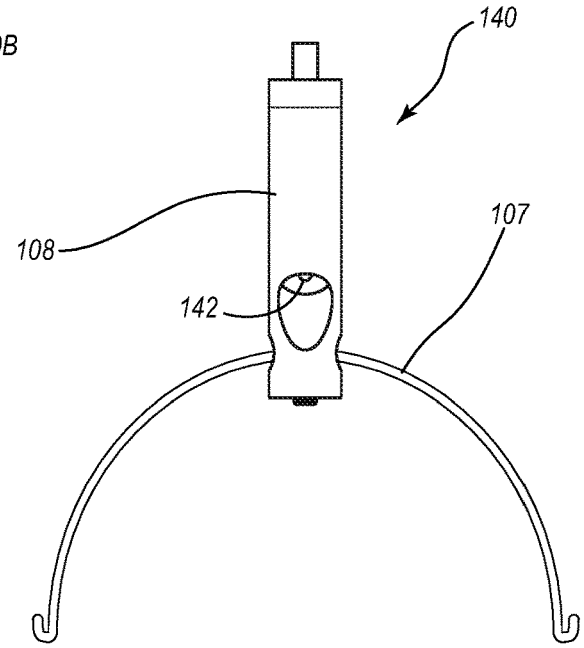
FIG. 2A-2C illustrate various embodiments of a tension hanger used to hang a sound-dampening baffle and lighting apparatus.
Figure 2B:
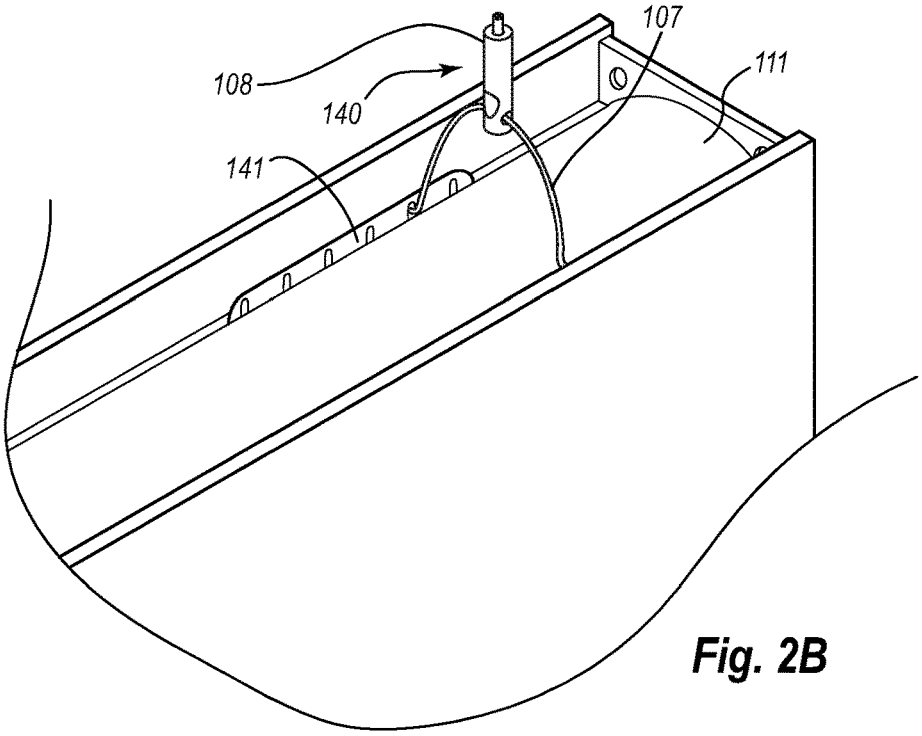
Figure 2C:
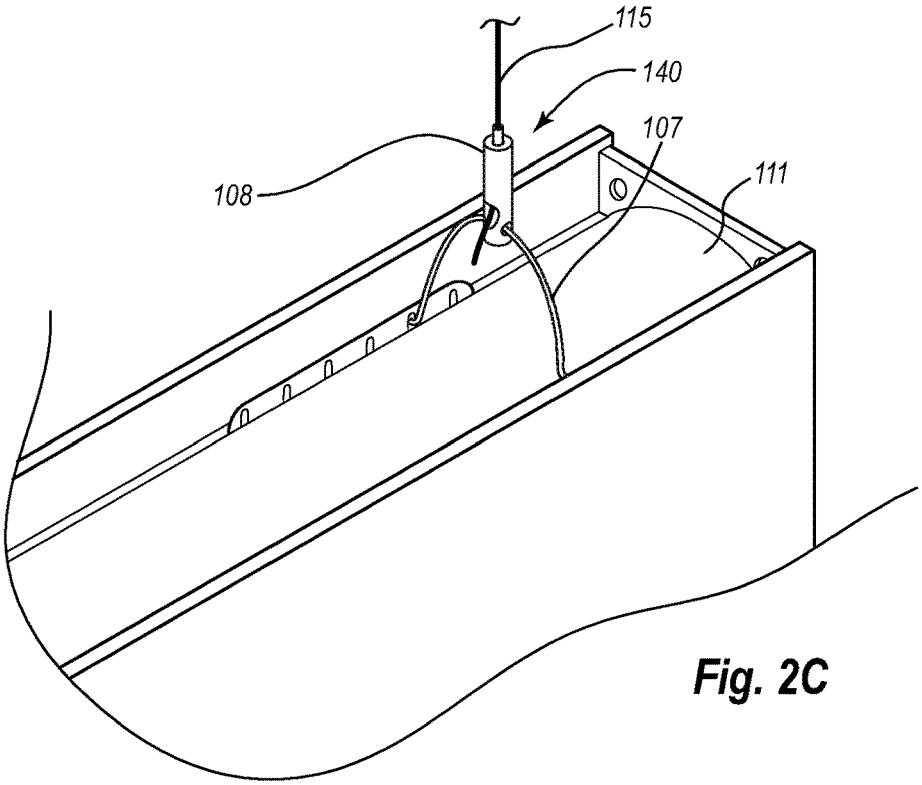

FIG. 2A illustrates a hanging apparatus 140 that can be used to hang the sound-dampening baffle and lighting apparatus 100. As shown in FIGS. 2B and 2C, the hanging apparatus 140 includes hooks 107 that attach the apparatus to holes in a mounting bracket 141. The mounting bracket may be affixed to or part of the structural frame 101 of FIG. 1A. The mounting bracket 141 may include many different holes to allow for different placement of the hooks 107. The hanging apparatus includes a body portion 108 that attaches to the hooks 107. The body portion includes a hollow shaft 142 that allows a line, wire, or cable 115 capable of holding the weight of the light fixture. The cable 115 extends from a ceiling mount (not shown) through the hollow shaft 142 and out from the body portion 108. Internal friction mounts, clips, screws or other means of securing the cable 115 to the body portion 108 may be used. In this manner, the light fixture 100 may be hung from ceilings, beams, roof lines or other structures capable of supporting the light fixture.

Figure 3:
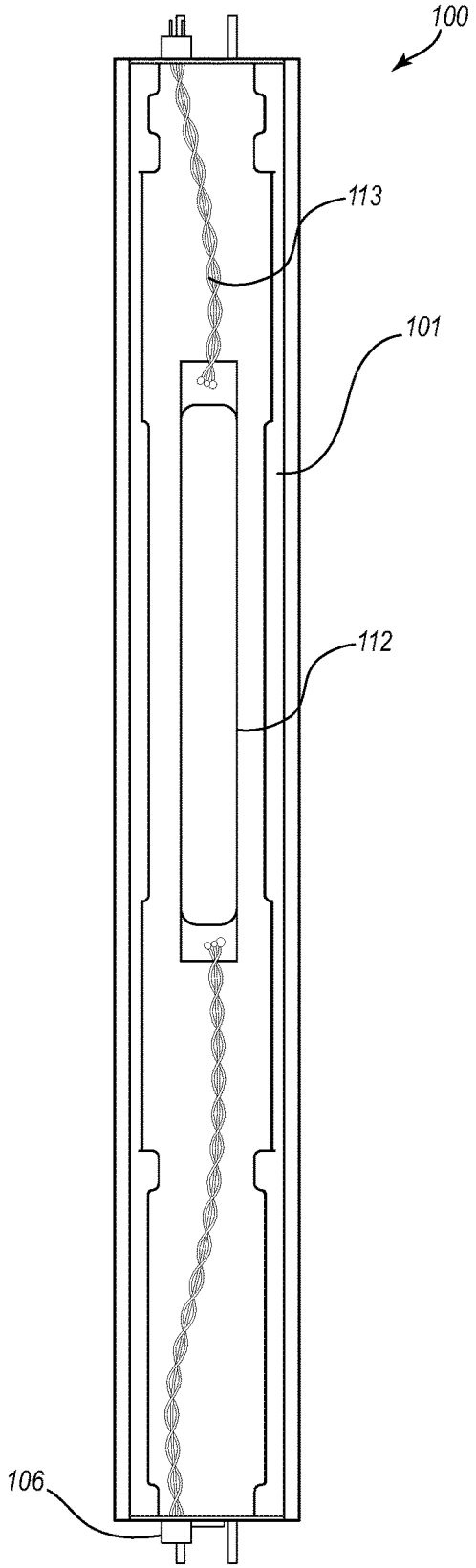
FIG. 3 illustrates a sound-dampening baffle and lighting apparatus that includes a lighting controller.

FIG. 3 illustrates an embodiment of the sound-dampening baffle and lighting apparatus 100 in which the diffuser 111 (or simply a top plate) has been removed. Removal of the diffuser/top plate reveals a light controller 112 similar to or the same as that shown in FIG. 1H. The light controller 112 is electrically connected to other light fixtures via electrical cables 113 and electrical connectors 106. The light controller may thus control a plurality of other light fixtures that may not be outfitted with controllers. The light controller 112 may be affixed to the structural frame 101 using screws, bolts, clips, weld joints or other fastening means. The light controller 112 may include one or more processors or microcontrollers, memory, data stores, solenoids or other electrical or electromechanical components that are used to control the operation of light sources.

Figure 4:
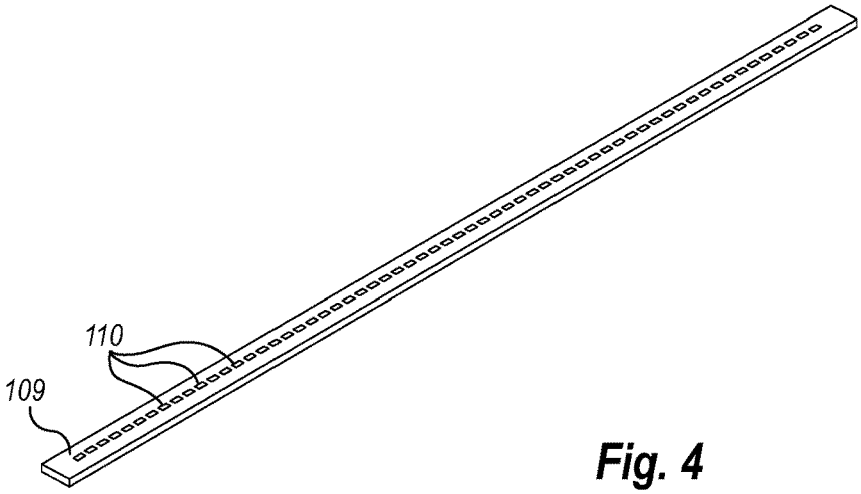
FIG. 4 illustrates an embodiment of a light strip.

For example, the light controller 112 may control when the light sources are turned on and off, the degree to which they are turned on, which individual bulbs or LED are illuminated, which strobe patterns are applied (if any), which color is selected (for multicolored lights), and other lighting options. Thus, interior decorators may have a large variety of options when using the light fixture described herein. In the LED light strip 109 of FIG. 4, the light controller 112 may be configured to control each LED light 110 individually. Multiple rows of LED light strips may be used, and each row may be illuminated in a way that compliments what is happening in the other rows. Various color combinations may be used to set a specific mood in a room. These may be changed as the needs of the room change, or as desired by an interior decorator.

Figure 5:
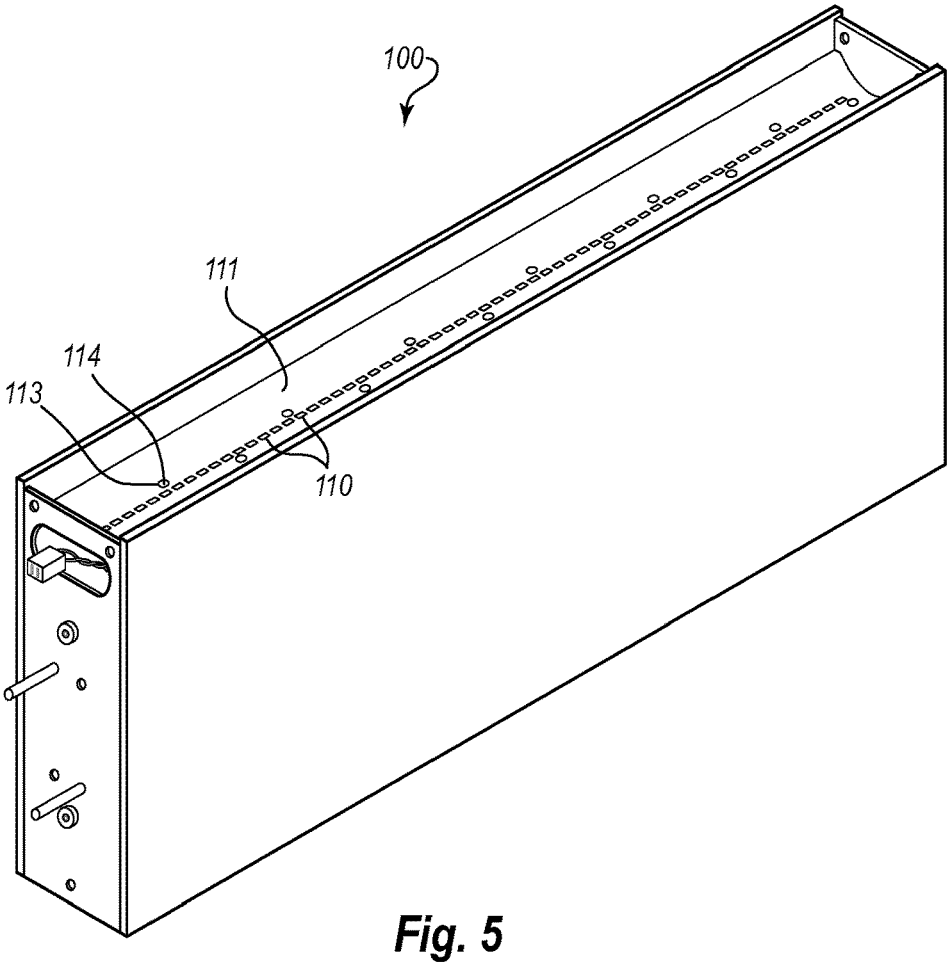
FIG. 5 illustrates an embodiment in which a diffuser or reflector is mounted over a light strip.

FIG. 5 illustrates an embodiment of the sound-dampening baffle and lighting apparatus 100 in which LED lights 110 are fastened to the diffuser 111. The lights may be part of light strips (e.g. 109) that are affixed to the top surface of the diffuser 111. Alternatively, the diffuser 111 may have holes or cavities etched therein that align with the LED lights of a light strip. In such cases, the LED light strip may be applied to the bottom surface of the diffuser 111, where the LED lights protrude up through the cavities in the diffuser.

Still further, in other embodiments, the LED lights (or other light sources) may be affixed to the structural frame, and the diffuser 111 may be placed over the LED lights such that the lights slide up through corresponding cavities in the diffuser. In some cases, the structural frame 101 may include protruding nubs 114 that are affixed to the frame. The diffuser may have separate holes or cavities 113 designed to accommodate these nubs 114. These holes 113, as shown in FIG. 5, align with the nubs 114 and hold the diffuser 111 in place. Indeed, the diffuser (or simply a top plate) may be snap fit into place, and may be held there by the nubs 114. Clips, screws, or other means of locking the diffuser in place may be used in addition to or as alternatives to those mentioned above.

Figure 6:
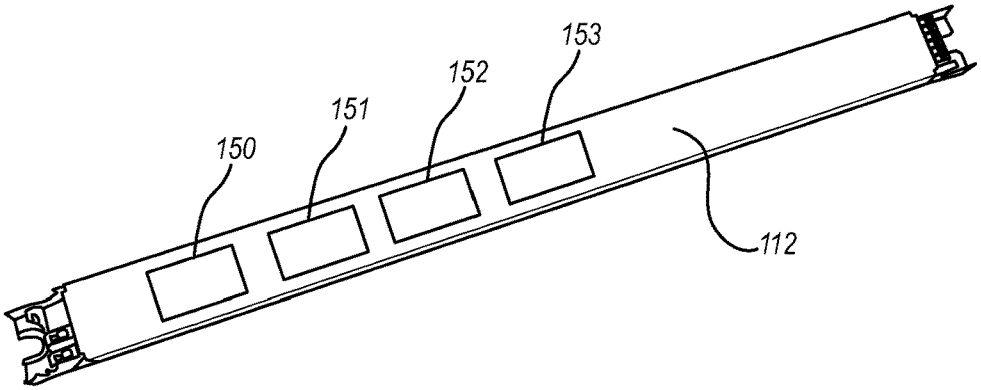
FIG. 6 illustrates an embodiment of a lighting controller.

FIG. 6 illustrates a front perspective view of a light controller 112. The light controller may have various electronic components including a processor 150, volatile memory (e.g. RAM) 151, non-volatile memory (flash or ROM) 152, and a wireless transceiver 153. Other electronic components may be included in the controller 112 including light detectors that help the controller to automatically adjust the lights based on the current amount of light in the room, or sound transducers that detect sound and help the controller adjust the lighting according to the sounds in the room. For example, the light controller 112 may be electrically connected to a microphone that detects sounds in a room. The light controller may then adjust the lights down in intensity if the sounds are quiet and a soft-toned atmosphere is desired; or, alternatively, the light controller may adjust the lights up if the sounds are loud and a bright atmosphere is desired or indicated. Thus, the sound-dampening baffle and lighting apparatus 100 may be designed to react to a detected atmosphere in a room, or may create the atmosphere based on a pre-programmed design stored in the non-volatile data store 152.

Figure 7:
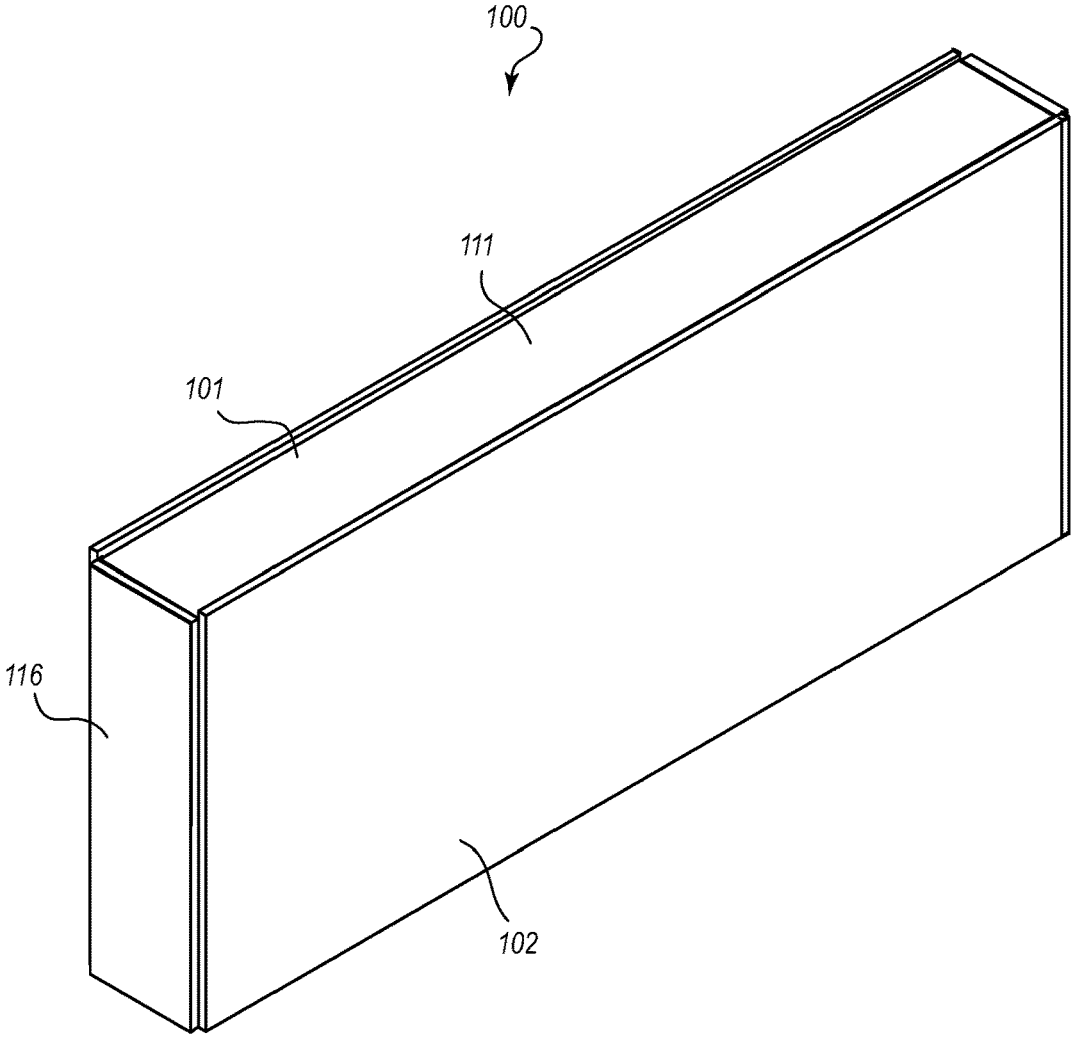
FIG. 7 illustrates an embodiment of a sound-dampening baffle and lighting apparatus that includes an additional end piece.

FIG. 7 illustrates an embodiment of a sound-dampening baffle and lighting apparatus 100 in which the apparatus has an end piece 116 providing a functional and aesthetic closure for one or both ends of the lighting apparatus. The end piece may be made of wood, metal, plastic or some other material, and may be coated with sound-dampening material. Such sound-dampening material (which may be used for any of the surfaces on the lighting apparatus 100) may include felted polyethylene terephthalate (PET) fibers. PET fibers may be manufactured and felted using a variety of known felting processes. The resulting felted PET fibers can be press-formed or heat-formed into rigid structures, such as the dark sound-dampening layer shown in the lighting apparatus 100 of FIG. 7.

The sound-dampening layer 102 may be relatively thin (e.g. 1/16"-1/8") to relatively thick (1/2"-3/4"), and may be made of a single material or a combination of materials. Indeed, some sound-dampening layers may include wood, metal or plastic portions, in addition to felted PET portions. In some cases, the felted PET portions may be composed of recycled PET. This felted PET may be applied to the side piece 116, as well as to the side portions (102), or to the bottom or top of the lighting apparatus. Additional sound-dampening material works to further reduce standing waves in a room, thus leading to better overall acoustics. The end piece 116 may be separable attached to the structural frame so that, if a user needs access to the electrical connector 106 to attach the light fixture to another light fixture, the user can simply remove the end piece and attach the new light fixture.

Figure 8:
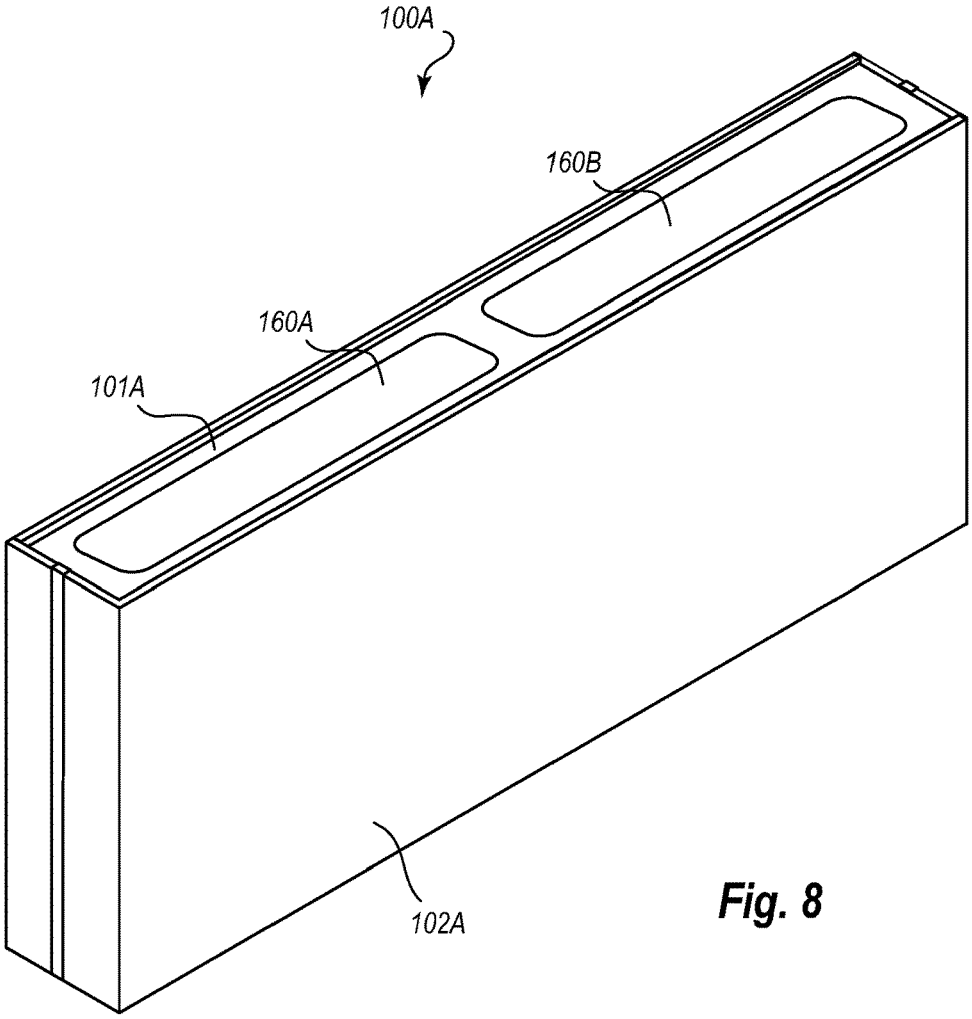
FIG. 8 illustrates an alternative embodiment of a sound-dampening baffle and lighting apparatus.

FIG. 8 illustrates an alternative embodiment of a sound-dampening baffle and lighting apparatus 100A. In this embodiment, the top of the structural frame 101A includes large recesses 160A and 160B. Light sources may be placed within or on top of these recesses. Additionally or alternatively, wiring and/or a lighting controller (e.g. 112) may be placed within these recesses. The sound-dampening outer layer 102A may be designed to extend above the top portion of the structural frame 101A. This functions to direct the light emanating out of the light fixture upward.

Figure 9A:
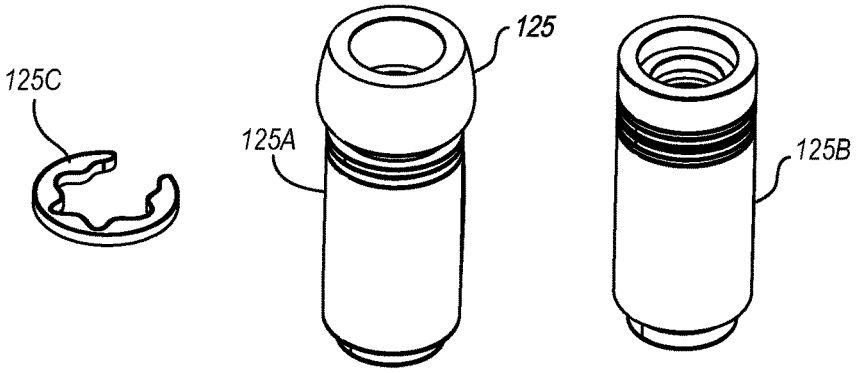
FIGS. 9A-9C illustrate views of a snap connector and snap ring for connecting sound-dampening baffle and lighting apparatuses.
Figure 9B:
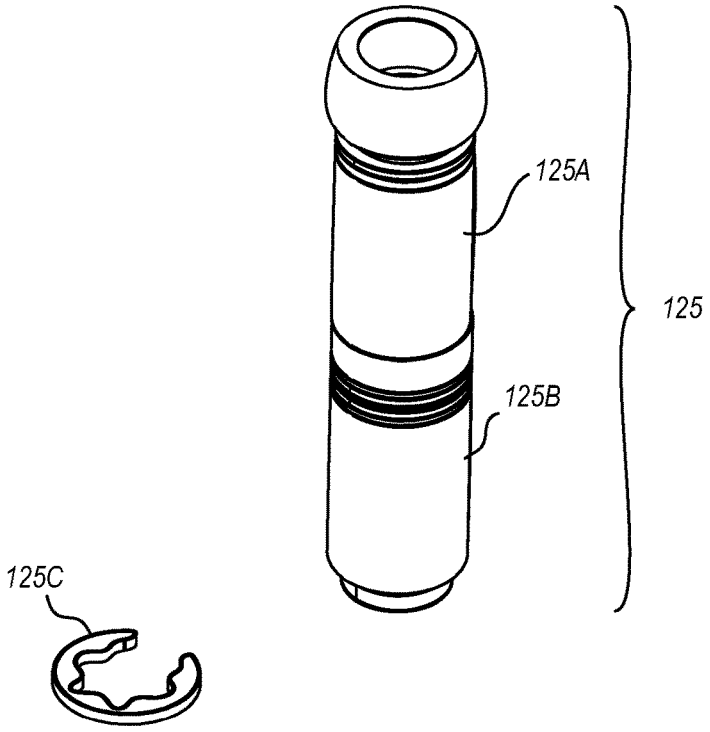
Figure 9C:
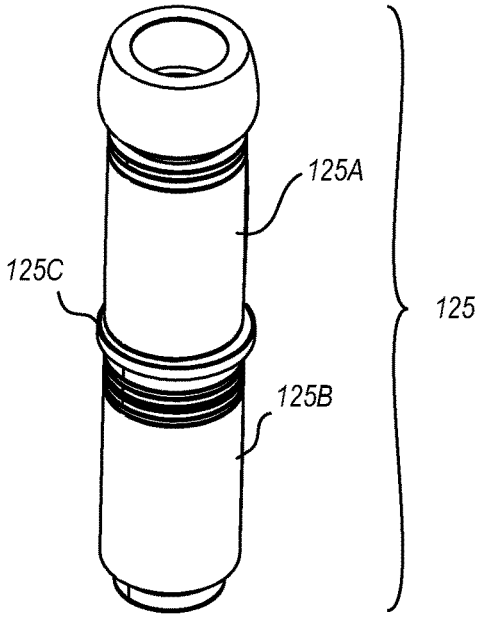

As indicated above, multiple light fixtures may be linked together using linkages such as those shown in FIGS. 1A-1C, including 103, 104 and 105. Other linking means may include those shown in FIGS. 9A-9C. In FIG. 9A, a linking piece 125 is shown having three component parts: 125A, 125B and 125C. Components 125A and 125B may be configured to snap fit together or screw together using threads and grooves. Still further, the components may be locked together using a snap-in locking piece 125C that secures piece 125A to piece 125B. To undo the connection, the locking piece 125C can be removed, and the other pieces can be snapped out or unscrewed. The components 125A and 125B may be hollow conduits that allow wires to be run through them. Using such connecting pieces, many different sizes and shapes of light fixtures may be linked in a way that allows for easy separation and reattachment.

Figure 10:
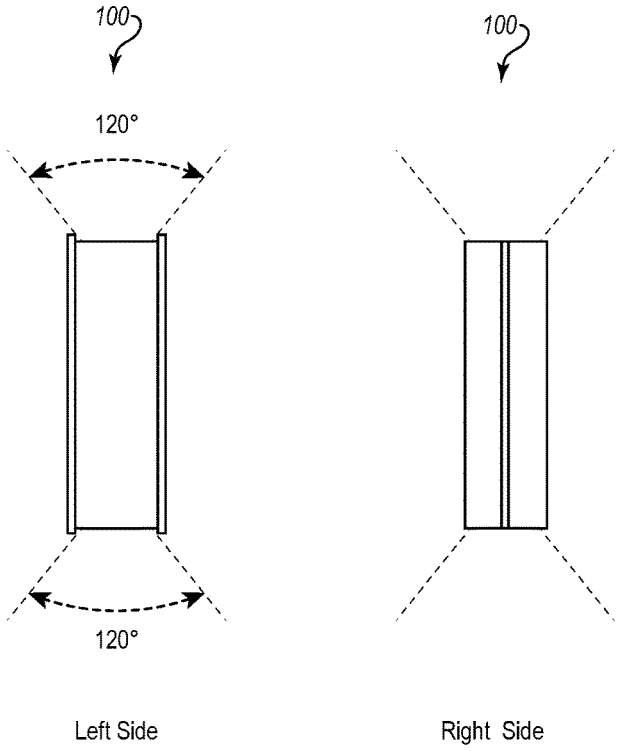
FIG. 10 illustrates left side and right side views of a sound-dampening baffle and lighting apparatus with light emanating therefrom.
Figure 11:
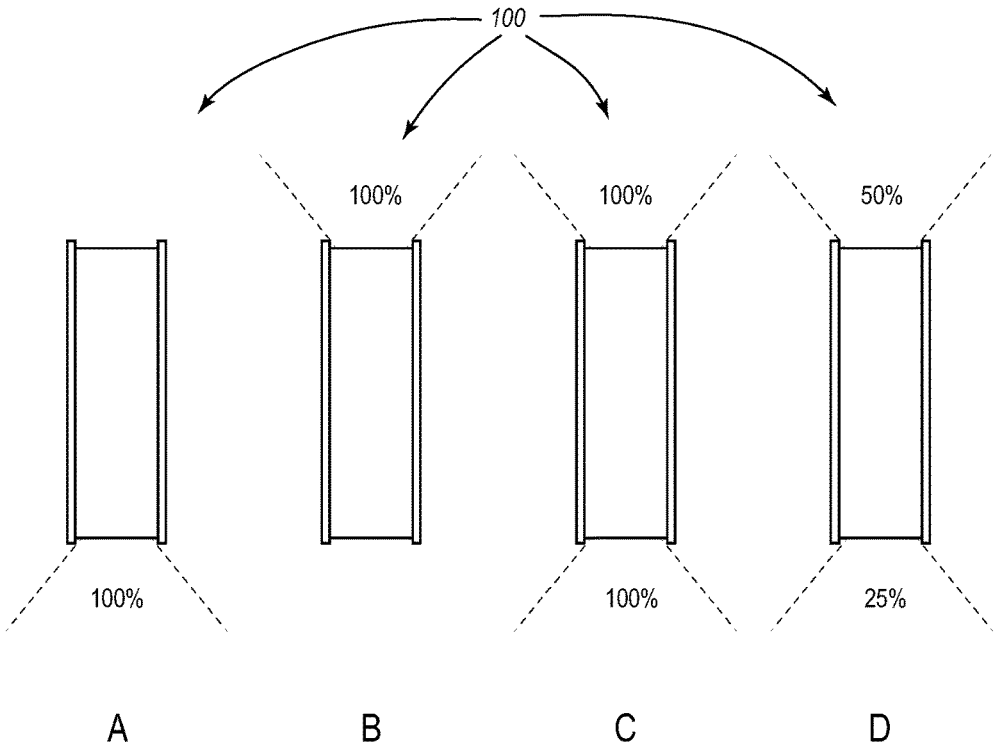
FIG. 11 illustrates various lighting embodiments for a sound-dampening baffle and lighting apparatus.

FIG. 10 shows left side and right side views of an example sound-dampening baffle and lighting apparatus 100. In FIG. 10, the light is designed to exit the lighting apparatus along a span of 120 degrees. In FIG. 11, the light is designed to exit the lighting apparatus at 100 degrees. Other orientations and light spans may be used as desired. In FIG. 11, the lighting apparatus in A has only bottom lights operating while the lighting apparatus in B has only top lights operating. In lighting apparatus C, both top and bottom lights are on at a full 100%, while in lighting apparatus D, both top and bottom lights are on, but at 50% on top and only a subdued 25% on the bottom. Thus, the directionality, span, intensity and other elements of the light provided by the lighting apparatus may all be controlled using the controller 112.

Figure 12A:
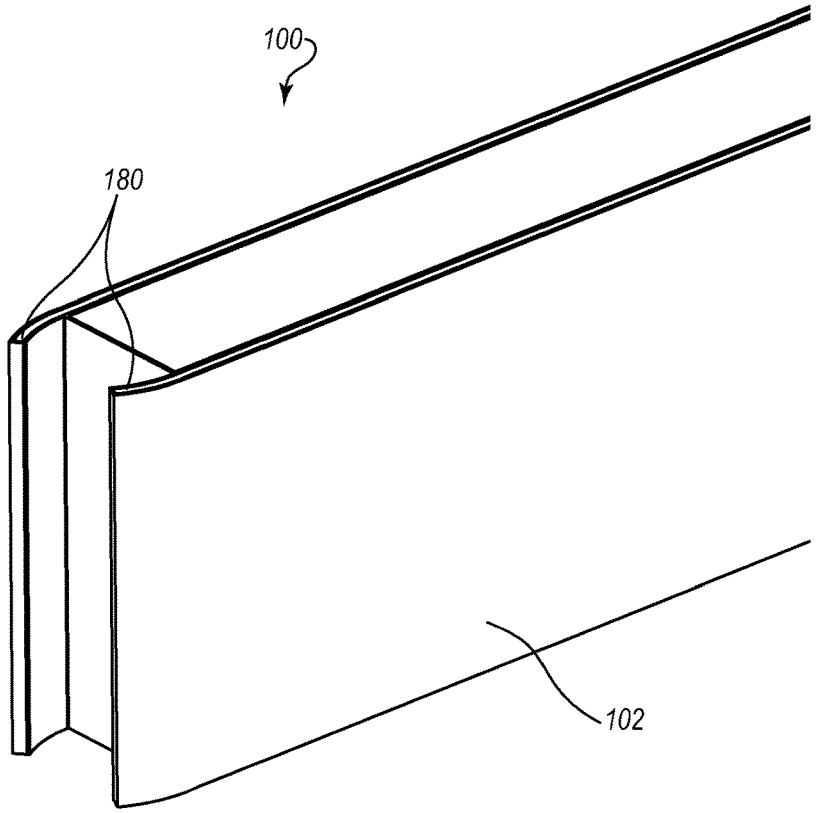
FIGS. 12A and 12B illustrate front and back perspective views of a hanging sound-dampening baffle and lighting apparatus.
Figure 12B:
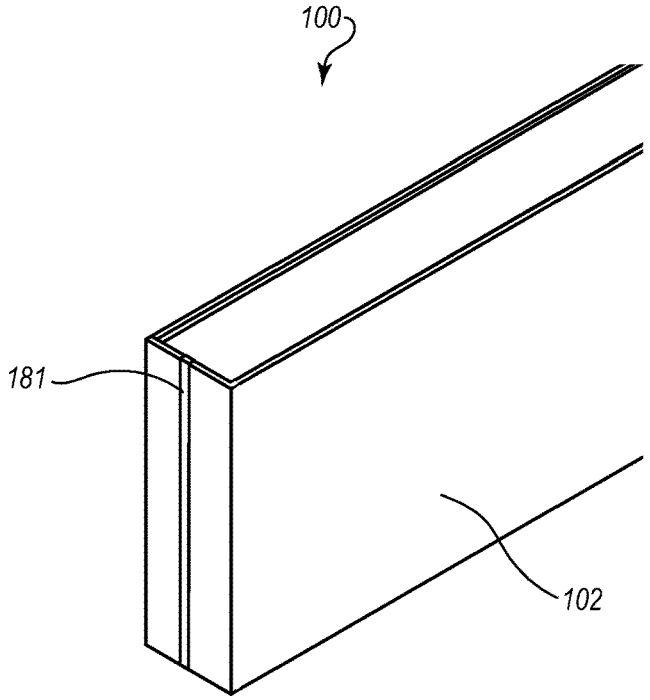
Figure 13A:
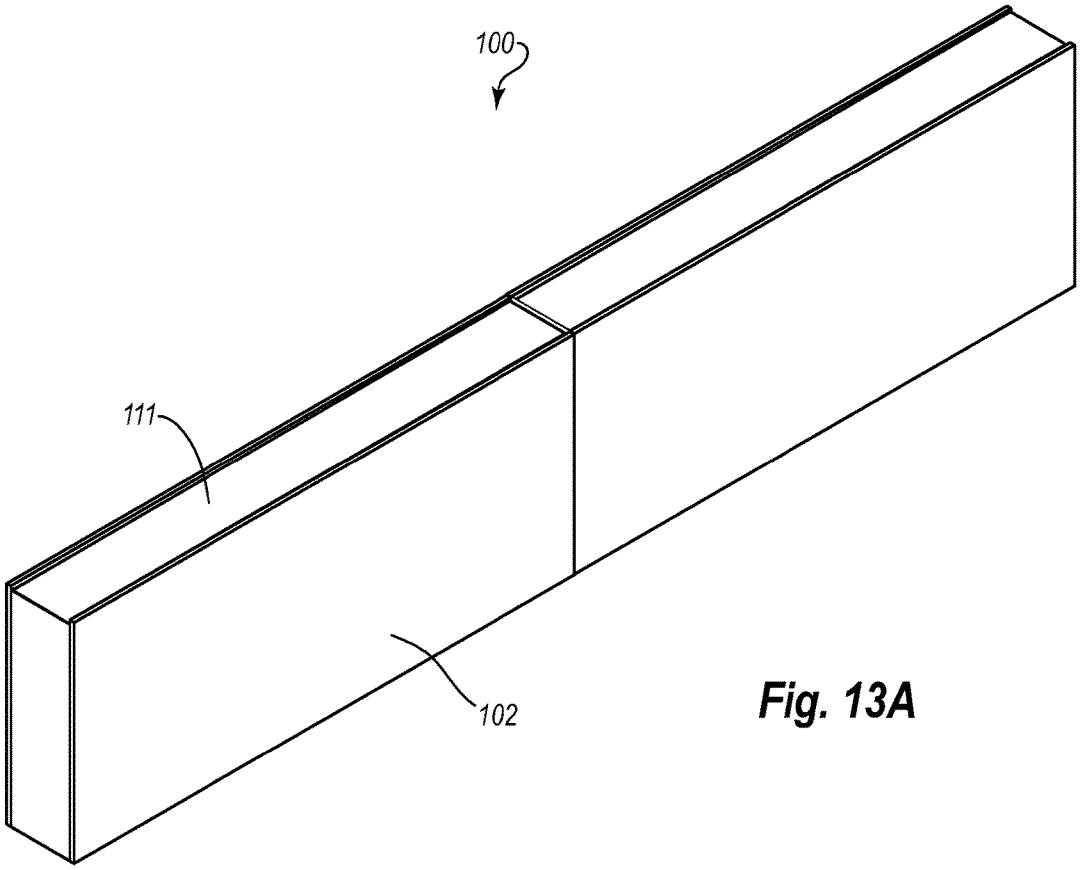
FIGS. 13A-13C illustrate front and back perspective views of an alternative hanging sound-dampening baffle and lighting apparatus.
Figure 13B:
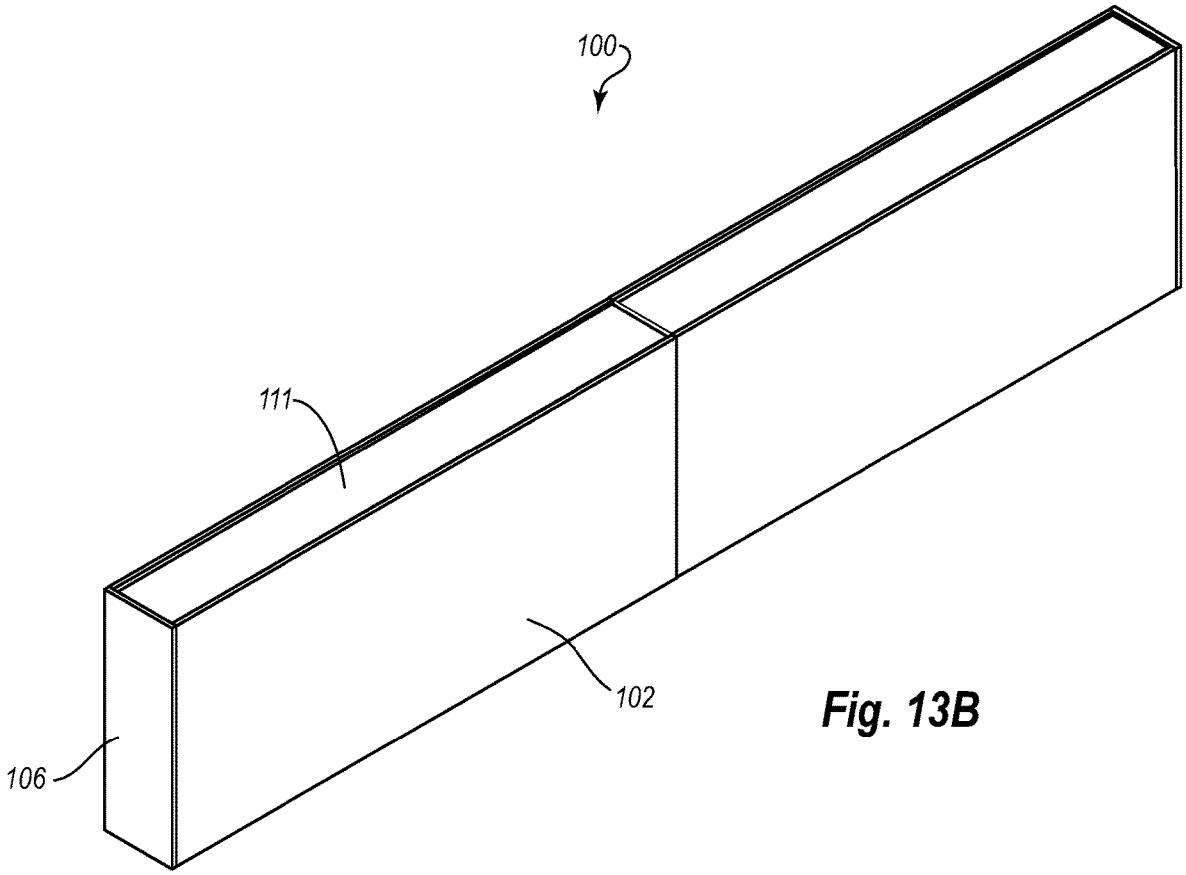
Figure 13C:
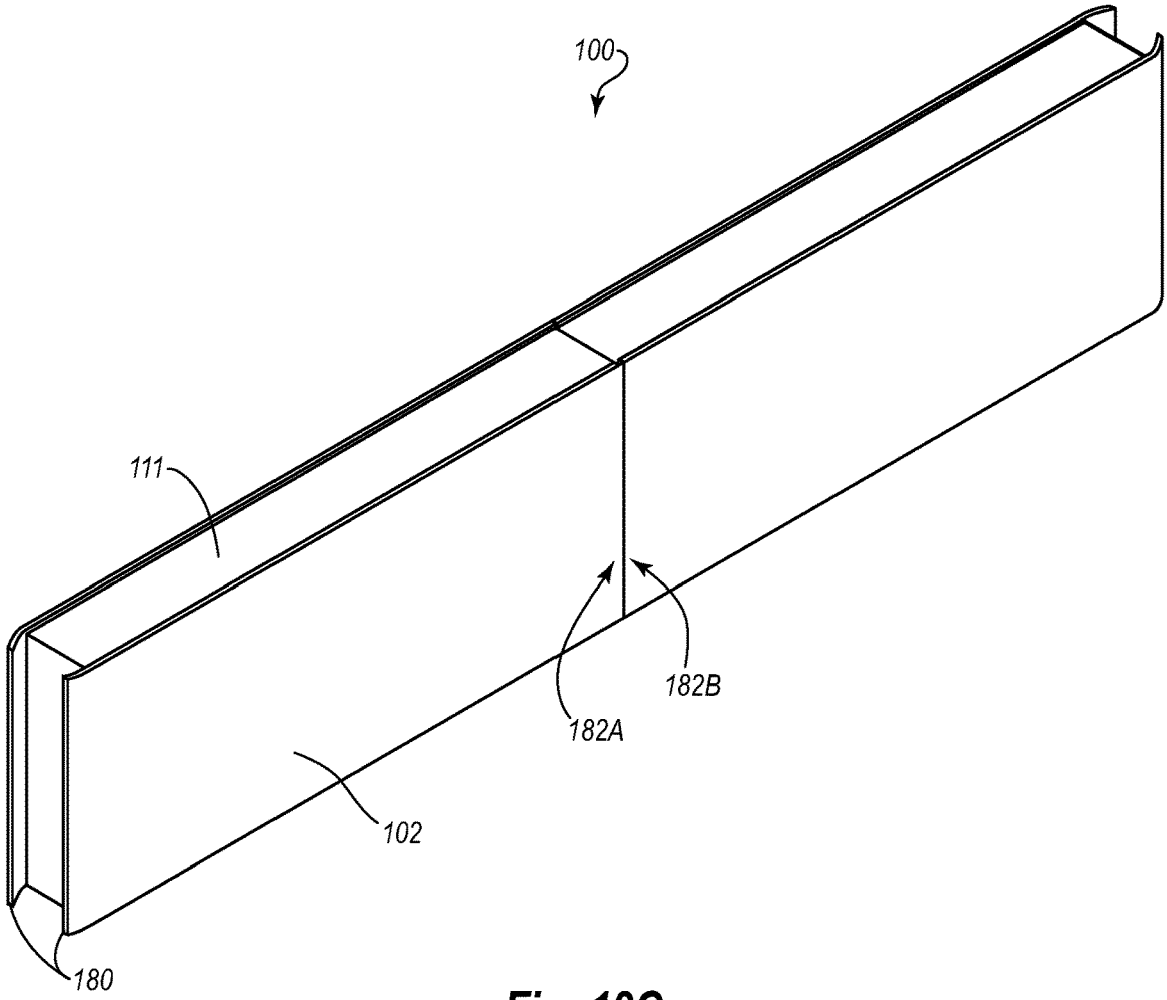

FIGS. 12A and 12B illustrate different designs in which the sound-dampening outer layer 102 is wrapped around the underlying structural frame 101. In FIG. 12A, the sound-dampening outer layer 102 may wrap around into tapered ends 180 that are functional in directing light or dampening sound. In some cases, the sound-dampening outer layer may be wrapped into shapes that are more aesthetically pleasing or that correspond to a certain design style. In FIG. 12B, the sound-dampening outer layer 102 folds around the sides toward the center. Near the center is a removable center strip 181 that allows access the inner components of the lighting fixture. FIGS. 13A and 13B illustrate front and back perspective views of multiple lighting fixtures linked together, while FIG. 13C illustrates an embodiment of multiple lighting fixtures whose ends each have curved edges 180, while the center portions 182A and 182B omit the curved edges so that they will fit together without overlap.

Thus, the sound-dampening baffle and lighting apparatus 100 may take many different forms depending on application or design. Different shapes and sizes of lights may be used within the lighting apparatus. The lighting apparatus 100 may have channels or diffusers through which the light provided by the light sources is shined. These channels or diffusers guide or diffuse the light from the light source(s) according to a specified design. The sound-dampening outer layer 102 provides sound-dampening qualities that reduce reverberations, standing waves, noise and other distracting sounds. Thus, in this manner, the sound-dampening baffle and lighting apparatus 100 may provide both the light of a lighting apparatus and the sound-dampening qualities of an acoustic baffle.

In some cases, light sources in the baffle may include relatively thin diffusers, allowing substantially all of the light generated by the light sources to be emanated. In other cases, the diffusers may be thicker, thereby subduing the light for use in situations where low light is desirable (e.g. restaurants). The baffle may take the shape of a beam or a box, or may be circular or triangular. These baffles may be linked together, physically and electrically. For example, the controller used to control the lights may be linked to multiple different baffles, and may control the lighting features on each baffle, either alone or in conjunction with the group of baffles. When multiple baffles are linked together, this may be referred to as a sound-dampening array or a sound-dampening and lighting array. Such arrays may be used to control the acoustic and lighting properties of a given room. For instance, a user may turn the upward-facing or downward-facing lights on or off, or may use different diffusers or channels to change the mood and/or direction of the light.

The sound-dampening baffle and lighting apparatus (or an array of such apparatuses) may be positioned in a specified location or in a specified pattern on a wall or ceiling. The apparatus may be hung from the ceiling, or may be attached to a wall or other structure. The apparatus may be, for example, 12, 16 or 24 inches tall. In other cases, the apparatus may be shorter or taller. Similarly, the lighting apparatus may be 6, 8 or 10 feet long, or longer or shorter depending on the room or area into which the apparatus is to be placed. The sound-dampening baffle and lighting apparatus 100 may include multiple sound-dampening layers that are specifically designed to reduce echoes and reverberations within a room. For instance, a foam layer may be disposed on the inside of the sound-dampening outer layer (i.e. between the structural frame 101 and the outer layer 102). Such baffles trap the sound emanated to them, and thus significantly reduce reverberations within a room.

In one embodiment, a sound-dampening baffle and lighting apparatus 100 is designed to specifically dampen sounds between 250 and 4000 Hz. This frequency range is the typical range in which a person speaks or sings. Accordingly, it is especially advantageous to dampen sound in this frequency range. If such frequencies are permitted to echo or reverberate within a room, it can be incredibly difficult to understand what a person is saying. As such, the shape of the baffle, the size of the baffle, and the materials and thickness of the sound-dampening outer layer may all be specially selected to provide optimal acoustics within a room.

In some embodiments, a substantial increase in noise reduction coefficient (NRC) is provided by the apparatuses described herein. For example, testing has shown that the NRC is increased from a mere 0.65 for the felted PET fibers by themselves, to nearly 1.0, indicating that the baffle has nearly perfectly absorbed the surrounding sounds. User-controlled or pre-programmed lighting, in conjunction with the sound-dampening properties, allows the apparatus 100 to provide channeled, diffused, or untouched light, in many different directions, while at the same time providing improved acoustics in a room. Using such an apparatus, a user can carefully control both the lighting and sound qualities of a room.

If a single apparatus does not provide the level of control desired by a user, multiple such apparatuses may be linked together using the connectors shown in FIGS. 1A-1C and 9A-9C. A single light controller 112 may be used for a group of electrically connected (or wirelessly connected) apparatuses, or each fixture may have its own controller. This light controller may be a hardware controller with a software interface. Thus, a user may use his or her phone or other electronic device to control the lights in the baffles. The controller allows the level of brightness to be adjusted, allows the directionality of the light sources to be adjusted, allows individual on or off control of each light, and so on.

Diffusers, such as 111 or 118 of FIG. 1H, may be placed near light sources on the lighting apparatus 100. Each light source may have its own diffuser, or a single diffuser may be used for multiple light sources (e.g. multiple LED lights). The diffusers diffuse or redirect at least a portion of the light generated by the light source. In many of the Figures herein, the sound-dampening lighting apparatus 100 is designed and formed in the shape of a beam. It will be understood, however, by one skilled in the art that the lighting apparatus may be in the shape of a square, a triangle, a rectangle, a circle, a pyramid, a cylinder, a cube or substantially any other shape. Indeed, the sides, ends, top and bottom may be curved, angled, trimmed or otherwise shaped to dampen sound or reduce unwanted reverberations or echoes. As shown in FIG. 12A, for example, curved edges 180 may be used to improve the baffle's sound-dampening characteristics.

The lighting apparatuses may be hung from cables or affixed to walls or other surfaces alone or in tandem with other fixtures. For example, as shown in FIGS. 13A-13C, two (or more) light fixtures may be linked together using the linkages 103, 104 and/or 105 of FIGS. 1A-1G, or linkage 125 of FIGS. 9A-9C. As with the shapes of individual light fixtures, groups of light fixtures may be arranged in the shape of a square, rectangle, triangle, circle, cube, cylinder, trapezoid, etc. Each linkage may include mechanical and/or electrical linkages. The shapes chosen for groupings of lighting apparatuses may be chosen to provide lighting in a specified pattern for a particular room, for example.

As noted above, any air space within the sound-dampening baffle and lighting apparatus 100 (e.g. airspace 120 of FIG. 1H) may be left as is, or may be filled with some material. For example, the airspace 120 may be filled with foam or other insulating material. This foam may further improve the baffle characteristics of the sound-dampening baffle and lighting apparatus 100. The foam may be applied in different thicknesses, resulting in different baffle characteristics. The thickness of the foam may be selected for a specific room, or to dampen a certain range of frequencies. In some cases, materials may be applied (on the inside or the outside of the apparatus 100) that are specifically designed to dampen sounds between approximately 250 and 4,000 Hz. This greatly reduces the reverberation of human voices, which is especially noticeable in a large room with a vast number of people.

The sound-dampening baffle and lighting apparatus 100 may be wired to a traditional light switch, such that control of the apparatus is performed using the light switch. Additionally or alternatively, a wireless remote or user's phone or wearable device may be used to control the apparatus 100. Such wireless devices communicate with a wireless radio within the controller 112 that allows a user to switch directionality, intensity, or other properties of the light. If multiple lighting apparatuses are linked together (e.g. via snap-fit linear conduits 125), one controller 112 may be used to control the entire group of fixtures. Such snap-fit linear conduits are designed to substantially align the sound-dampening baffle and lighting apparatuses in a particular direction (e.g. in a row, or in a square). Magnets (e.g. 105) may additionally be used to align and hold the fixtures in place.

Figure 14:
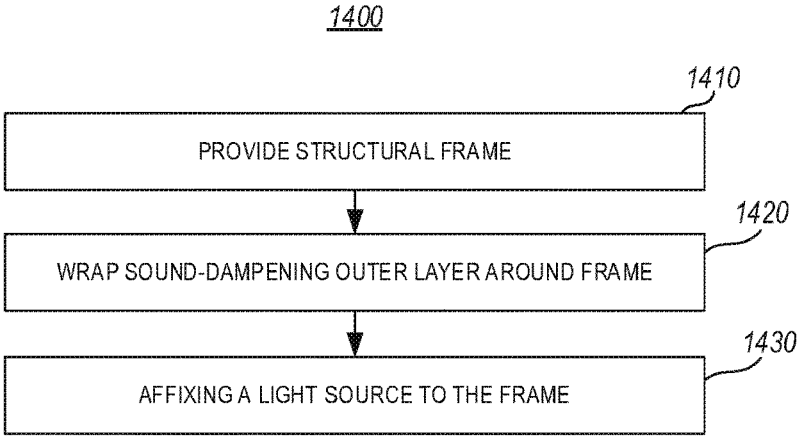
FIG. 14 illustrates a method of manufacturing a sound-dampening baffle and lighting apparatus.

In one embodiment, as generally shown in FIG. 14, a method 1400 of manufacturing a sound-dampening baffle and lighting apparatus is provided. The method 1400 includes providing a structural frame (e.g. 101) that supports a sound-dampening outer layer 102 and at least one light source 110 (1410). The method next includes wrapping the sound-dampening outer layer 102 around at least a portion of the structural frame 101, where the sound-dampening outer layer includes sound-dampening material (1420). The method also includes affixing the light source 110 to the structural frame 101 (1430). The light source is directionally switchable such that light emanating from the light source points upward, downward or both.

The sound-dampening baffle and lighting apparatus 100 may be attached to a ceiling mount via one or more support lines 115. A first end of the support line is attached to the ceiling mount (not shown) and a second end of the support line 115 is attached to a mount on the structural frame (e.g. mount 141 on frame 101 of FIG. 2C). The support line 115 may be retractable such that it can be drawn back in to the ceiling mount. This allows the lighting apparatus 100 to be raised or lowered to a desired height.

In another embodiment, a light fixture (e.g. 100) is provided which includes an interior frame (e.g. 101) that provides structural support for one or more external layers (e.g. 102). The light fixture 100 further includes a hanging apparatus 140 connected to the interior frame 101 that allows the light fixture to be hung from a ceiling. The light fixture 100 further includes an external sound-dampening layer 102 wrapped around at least part of the interior frame 101. The light fixture 100 also has lights (110) mounted on the interior frame. The lights are programmable to cast light in a variety of directions. Furthermore, the light fixture 100 includes a controller (e.g. 112) electrically connected to the lights 110. The controller 112 is configured to direct light from the lights in a specified direction (e.g. upwards or downwards, as shown in FIG. 11).

The light fixture may include recesses 104 and alignment elements 103. The alignment elements 103 of the light fixture 100 align with the corresponding recesses 104 in another light fixture. Once joined together, the two light fixtures may be held in place in this position until disconnected. The fixtures may be held in place via a snap-fit connection, via magnets (e.g. 105), via screws or bolts or other fasteners. The light fixture may have one or more diffusers, each of which may have cavities that align with LED (or other) lights provided in a light strip (e.g. 109), such that the lights protrude through the diffusers. Reflectors may be used in addition to or as an alternative to diffusers. In some cases, the diffusers may be snap fit into the interior frame, and held in place via protruding nubs (e.g. 114 of FIG. 5) affixed to the structural frame 100 that protrude into corresponding recesses 113 in the diffuser 111.

Accordingly, a sound-dampening baffle and lighting apparatus is provided which allows users to control both lighting and acoustics in a room using a single apparatus. Lighting characteristics can be controlled wirelessly via a controller, and sound characteristics can be controlled by appropriately sizing and placing the baffle and lighting apparatus in specified locations within a room. The concepts and features described herein may be embodied in other specific forms without departing from their spirit or descriptive characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

I claim:

1. A sound-dampening baffle and lighting apparatus, comprising:

a structural frame that provides support for a sound-dampening outer layer and at least one light source;

the sound-dampening outer layer, which is disposed around at least a portion of the structural frame, the sound-dampening outer layer comprising sound-dampening material;

the at least one light source disposed on the structural frame, the light source being directionally switchable such that light emanating from the light source points upward, downward or both; and a diffuser, wherein the diffuser is snap fit into the structural frame and held in place via one or more protruding nubs affixed to the structural frame that protrude into corresponding recesses in the diffuser.

2. The sound-dampening baffle and lighting apparatus of claim 1, wherein the diffuser is configured to diffuse at least a portion of the light generated by the light source.

3. The sound-dampening baffle and lighting apparatus of claim 1, wherein the sound-dampening lighting apparatus is formed in the shape of a rectangular beam.

4. The sound-dampening baffle and lighting apparatus of claim 3, wherein a plurality of rectangular beam-shaped sound-dampening baffle and lighting apparatuses are linked together via a mechanical and/or electrical linkage.

5. The sound-dampening baffle and lighting apparatus of claim 4, wherein the plurality of rectangular beam-shaped sound-dampening baffle and lighting apparatuses are positioned in a specified pattern on a wall or ceiling to providing lighting in a specified pattern.

6. The sound-dampening baffle and lighting apparatus 1, further comprising a foam layer disposed between the structural frame and the sound-dampening outer layer.

7. The sound-dampening baffle and lighting apparatus of claim 1, wherein the sound-dampening baffle and lighting apparatus is designed to dampen sounds between approximately 250 and 4,000 Hz.

8. The sound-dampening baffle and lighting apparatus of claim 1, further comprising a controller that allows a user to switch directionality of the light provided by the source.

9. The sound-dampening baffle and lighting apparatus of claim 1, further comprising a snap-fit linear conduit that links two or more sound-dampening baffle and lighting apparatuses.

10. The sound-dampening baffle and lighting apparatus of claim 9, wherein the snap-fit linear conduit substantially aligns the two or more sound-dampening baffle and lighting apparatuses.

11. The sound-dampening baffle and lighting apparatus of claim 1, further comprising one or more magnets positioned on at least one end of the sound-dampening baffle and lighting apparatus, the one or more magnets being configured to align with one or more oppositely-charged magnets on a second sound-dampening baffle and lighting apparatus.

12. The sound-dampening baffle and lighting apparatus of claim 1, wherein the sound-dampening material comprises felted polyethylene terephthalate (PET) fibers.

13. The sound-dampening baffle and lighting apparatus of claim 1, wherein the sound-dampening lighting apparatus is formed in the shape of a triangular beam.

14. The sound-dampening baffle and lighting apparatus of claim 1, wherein the sound-dampening lighting apparatus is formed in the shape of a circular or cylindrical beam.

15. The sound-dampening baffle and lighting apparatus of claim 1, wherein the sound-dampening lighting apparatus is formed in the shape of a trapezoidal beam.

16. The sound-dampening baffle and lighting apparatus of claim 1, wherein the at least one light source comprises one or more strips of LED lights.

17. The sound-dampening baffle and lighting apparatus of claim 16, wherein the diffuser comprises a plurality of cavities that aligns with the one or more strips of LED lights.

18. A light fixture, comprising:

an interior frame that provides structural support for one or more external layers;

a hanging apparatus connected to the interior frame;

an external sound-dampening layer wrapped around at least a portion of the interior frame;

one or more lights mounted on the interior frame, the lights being programmable to cast light in a variety of directions;

a controller electrically connected to the one or more lights, the controller being configured to direct light from the one or more lights in one or more specified directions; and a diffuser having a plurality of cavities that aligns with one or more LED lights provided in a light strip.

19. The light fixture of claim 18, further comprising:

one or more recesses; and one or more alignment elements;

wherein the alignment elements of the light fixture align with one or more recesses and alignment elements of a second light fixture, such that the light fixture and the second light fixture are separably connected.

20. The light fixture of claim 18, wherein the diffuser is snap fit into the interior frame, and held in place via one or more protruding nubs affixed to the structural frame that protrude into corresponding recesses in the diffuser.

21. The light fixture of claim 18, further comprising a foam layer disposed between the interior frame and the external sound-dampening layer.

22. The light fixture of claim 18, wherein the sound-dampening baffle and lighting apparatus is designed to dampen sounds between approximately 250 and 4,000 Hz.

23. The light fixture of claim 18, wherein the external sound-dampening layer comprises felted polyethylene terephthalate (PET) fibers.

24. The light fixture of claim 18, wherein the interior frame is formed in the shape of a rectangular or cube beam.

25. The light fixture of claim 18, wherein the interior frame is formed in the shape of a triangular beam.

26. The light fixture of claim 18, wherein the interior frame is formed in the shape of a circular or cylindrical beam.

27. The light fixture of claim 18, wherein the interior frame us is formed in the shape of a trapezoidal beam.

28. A light fixture, comprising:

an interior frame that provides structural support for one or more external layers;

an external sound-dampening layer wrapped around at least a portion of the interior frame;

one or more lights mounted on the interior frame, the lights being programmable to cast light in a variety of directions;

a controller electrically connected to the one or more lights, the controller being configured to direct light from the one or more lights in one or more specified directions; and a diffuser, wherein the diffuser is snap fit into the interior frame and held in place via one or more protruding nubs affixed to the interior frame that protrude into corresponding recesses in the diffuser.

29. The light fixture of claim 28, further comprising:

one or more recesses; and one or more alignment elements;

wherein the alignment elements of the light fixture align with one or more recesses and alignment elements of a second light fixture, such that the light fixture and the second light fixture are separably connected.

30. The light fixture of claim 28, wherein the diffuser comprises a plurality of cavities that aligns with one or more LED light strips.

31. The light fixture of claim 28, further comprising a foam layer disposed between the interior frame and the external sound-dampening layer.

32. The light fixture of claim 28, wherein the sound-dampening baffle and lighting apparatus is designed to dampen sounds between approximately 250 and 4,000 Hz.

33. The light fixture of claim 28, wherein the external sound-dampening layer comprises felted polyethylene terephthalate (PET) fibers.

34. A sound-dampening baffle and lighting apparatus, comprising:

a structural frame that provides support for a sound-dampening outer layer and at least one light source;

the sound-dampening outer layer, which is disposed around at least a portion of the structural frame, the sound-dampening outer layer comprising sound-dampening material;

the at least one light source comprising one or more LED light strips disposed on the structural frame, the light source being directionally switchable such that light emanating from the light source points upward, downward or both; and a diffuser, wherein the diffuser comprises a plurality of cavities that aligns with the one or more LED light strips.

35. The sound-dampening baffle and lighting apparatus of claim 34, wherein the diffuser is configured to diffuse at least a portion of the light generated by the light source.

36. The sound-dampening baffle and lighting apparatus of claim 34, wherein the sound-dampening lighting apparatus is formed in the shape of a rectangular beam.

37. The sound-dampening baffle and lighting apparatus of claim 36, wherein a plurality of rectangular beam-shaped sound-dampening baffle and lighting apparatuses are linked together via a mechanical and/or electrical linkage.

38. The sound-dampening baffle and lighting apparatus of claim 37, wherein the plurality of rectangular beam-shaped sound-dampening baffle and lighting apparatuses are positioned in a specified pattern on a wall or ceiling to providing lighting in a specified pattern.

39. The sound-dampening baffle and lighting apparatus 39, further comprising a foam layer disposed between the structural frame and the sound-dampening outer layer.

40. The sound-dampening baffle and lighting apparatus of claim 34, wherein the sound-dampening baffle and lighting apparatus is designed to dampen sounds between approximately 250 and 4,000 Hz.

41. The sound-dampening baffle and lighting apparatus of claim 34, further comprising a controller that allows a user to switch directionality of the light provided by the source.

42. The sound-dampening baffle and lighting apparatus of claim 34, further comprising a snap-fit linear conduit that links two or more sound-dampening baffle and lighting apparatuses.

43. The sound-dampening baffle and lighting apparatus of claim 42, wherein the snap-fit linear conduit substantially aligns the two or more sound-dampening baffle and lighting apparatuses.

44. The sound-dampening baffle and lighting apparatus of claim 34, further comprising one or more magnets positioned on at least one end of the sound-dampening baffle and lighting apparatus, the one or more magnets being configured to align with one or more oppositely-charged magnets on a second sound-dampening baffle and lighting apparatus.

45. The sound-dampening baffle and lighting apparatus of claim 34, wherein the sound-dampening material comprises felted polyethylene terephthalate (PET) fibers.

46. The sound-dampening baffle and lighting apparatus of claim 34, wherein the diffuser is snap fit into the structural frame and held in place via one or more protruding nubs affixed to the structural frame that protrude into corresponding recesses in the diffuser.

47. A sound-dampening lighting apparatus comprising felted polyethylene terephthalate (PET) fiber, comprising:

a structural frame that provides support for a sound-dampening outer layer; and at least one light source comprising one or more LED light strips disposed within the structural frame, the light source being directionally switchable such that light emanating from the light source points upward, downward or both;

wherein the sound-dampening outer layer comprises felted PET fiber that is wrapped around at least a portion of the structural frame, at least one end piece disposed on at least one end of the sound-dampening lighting apparatus;

a diffuser, wherein the diffuser is snap fit into the structural frame and held in place via one or more interlocking nubs and recesses, wherein the nubs protrude into the recesses formed in the structural frame or diffuser.

48. The sound-dampening lighting apparatus of claim 47, further comprising a controller that allows a user to switch directionality of the at least one light source.

49. The sound-dampening lighting apparatus of claim 48, wherein the controller comprises a hardware controller with a software interface that enables the user to control the directionality of the at least one light source with a mobile device.

50. The sound-dampening lighting apparatus of claim 47, further comprising a foam layer disposed between the structural frame and the sound-dampening outer layer.

51. The sound-dampening lighting apparatus of claim 47, wherein the sound-dampening lighting apparatus is designed to dampen sounds between approximately 250 and 4,000 Hz.

52. The sound-dampening lighting apparatus of claim 47, wherein the at least one end piece is composed of metal or wood.

53. The sound-dampening lighting apparatus of claim 47, wherein the at least one end piece is composed of resin or ceramic.

54. The sound-dampening lighting apparatus of claim 47, wherein the diffuser comprises a plurality of cavities that aligns with one or more LED light strips.

55. The sound-dampening lighting apparatus of claim 47, wherein the sound-dampening lighting apparatus is formed in the shape of a rectangular beam.

* * * * *